US009989330B2

(12) United States Patent
Wood et al.

(10) Patent No.: US 9,989,330 B2
(45) Date of Patent: Jun. 5, 2018

(54) CONVERSION KIT WITH A RAIL SYSTEM FOR A PAINTBALL MARKER HAVING A HINGED PORTION

(71) Applicant: Planet Eclipse Limited, Trafford Park, Manchester (GB)

(72) Inventors: Jack Kingsley Wood, Chelford (GB); Matthew Harry Mahoney, Wilmslow (GB)

(73) Assignee: PLANET ECLIPSE LIMITED, Manchester (GB)

( * ) Notice: Subject to any disclaimer, the term of this patent is extended or adjusted under 35 U.S.C. 154(b) by 0 days. days.

(21) Appl. No.: 14/960,656

(22) Filed: Dec. 7, 2015

(65) Prior Publication Data

US 2016/0084610 A1 Mar. 24, 2016

Related U.S. Application Data

(63) Continuation-in-part of application No. 13/775,414, filed on Feb. 25, 2013, now Pat. No. 9,273,926.

(Continued)

(51) Int. Cl.

*F41A 11/04* (2006.01)
*F41C 23/12* (2006.01)

(Continued)

(52) U.S. Cl.

CPC ..... *F41B 11/70* (2013.01); *F41A 3/66* (2013.01); *F41B 11/62* (2013.01); *F41C 23/12* (2013.01);

(Continued)

(58) Field of Classification Search

CPC ..... F41B 11/70; F41B 11/62; F41B 11/89; F41G 11/003; F41A 3/66; F41A 99/00;

(Continued)

(56) References Cited

U.S. PATENT DOCUMENTS 3,512,290 A 5/1970 La Violette, Jr. et al.
3,611,607 A 10/1971 Donnell (Continued)

FOREIGN PATENT DOCUMENTS

CA 2631979 A1 11/2009
DE 102004014734 B3 9/2005
EP 2314976 A2 4/2011

OTHER PUBLICATIONS

US 3,685,104, 08/1972, Coon (withdrawn)

*Primary Examiner* — John E Simms, Jr.
(74) *Attorney, Agent, or Firm* — Barlow, Josephs & Holmes, Ltd.

(57) ABSTRACT

A convertible projectile launching device includes a projectile launching device, such as a paint ball marker, a less than lethal launcher or an airsoft gun, to which a user can secure at least one shell that changes the outer configuration or appearance of a projectile launching device on which it is secured into a MILSIM style projectile launching device. The shell includes at least one front shell portion and at least one rear shell portion that are connected by a hinge so the rear shell portion may pivot about the hinge with respect to the front portion. By operating a locking bolt on the rear shell portion, a user can selectively lock the orientation of the rear portion with respect to the underlying marker. The locking bolt may be spring biased to a locked position.

22 Claims, 33 Drawing Sheets

Related U.S. Application Data

(60) Provisional application No. 61/603,830, filed on Feb. 27, 2012.

(51) Int. Cl.

| | |
|---|---|
| ***F41B 11/70*** | (2013.01) |
| ***F41G 11/00*** | (2006.01) |
| ***F41A 3/66*** | (2006.01) |
| ***F41C 23/16*** | (2006.01) |
| ***F41C 23/20*** | (2006.01) |
| ***F41B 11/62*** | (2013.01) |

(52) U.S. Cl.
CPC ..... *F41C 23/16* (2013.01); *F41C 23/20* (2013.01); *F41G 11/003* (2013.01)

(58) Field of Classification Search
CPC ..... F41A 11/04; F41A 11/02; F41A 11/00; F41C 23/16; F41C 23/12; F41C 23/20; F41C 23/04
See application file for complete search history.

(56) References Cited

U.S. PATENT DOCUMENTS

| | | | | |
|---|---|---|---|---|
| 3,798,819 | A * | 3/1974 | Hillberg | F41C 23/04 42/71.01 |
| 4,601,123 | A * | 7/1986 | Swearengen | F41A 11/02 42/70.01 |
| 5,555,661 | A | 9/1996 | Yap | |
| 6,655,069 | B2 | 12/2003 | Kim | |
| 7,458,179 | B2 | 12/2008 | Swan | |
| 7,987,623 | B1 * | 8/2011 | Moody | F41A 23/08 42/71.01 |
| 8,141,289 | B2 * | 3/2012 | Gomez | F41C 23/16 42/90 |
| 8,205,373 | B1 * | 6/2012 | Ubl | F41C 23/16 42/71.01 |
| 8,713,838 | B2 | 5/2014 | Ubl et al. | |
| 2008/0168973 | A1 | 7/2008 | Levin et al. | |
| 2009/0282718 | A1 * | 11/2009 | Bartley | F41C 23/12 42/75.03 |
| 2010/0242333 | A1 * | 9/2010 | Kincel | F41C 23/04 42/73 |
| 2011/0283582 | A1 * | 11/2011 | Hunter | F41A 19/10 42/69.02 |
| 2014/0063791 | A1 * | 3/2014 | Frazier | F21L 4/00 362/110 |
| 2015/0316346 | A1 * | 11/2015 | Brandt | F41C 23/12 42/71.02 |
| 2016/0258714 | A1 * | 9/2016 | Drummond | F41C 23/16 |

* cited by examiner

CONVERSION KIT WITH A RAIL SYSTEM FOR A PAINTBALL MARKER HAVING A HINGED PORTION

CROSS REFERENCE TO RELATED APPLICATION

This application is a continuation-in-part of and claims priority to earlier filed non-provisional patent application Ser. No. 13/775,414, filed Feb. 25, 2013, which is related to and claims priority from earlier filed provisional patent application Ser. No. 61/603,830, filed Feb. 27, 2012, and the entire contents of each is incorporated herein by reference.

BACKGROUND OF THE INVENTION

The invention relates generally to paintball markers and air soft guns and the gameplay related thereto. The sport of paintball is very well known and includes the use of a paintball marker or gun to pneumatically launch a rubber ball or a ball that is typically filled with a colored liquid. For air soft, plastic projectiles are shot at opposing players or targets. Each of the players in the game has such a marker or gun so they can launch projectiles toward players on the opposing team. When players on the opposing team are marked or hit with a projectile, there is typically a scoring event.

The present invention is particularly related to the game of paintball and the related paintball markers. Therefore, the invention will be discussed in detail in connection with paintball markers for ease of illustration but it should be understood that the present invention is applicable to the air soft sport and air soft guns as well.

Also, the present invention relates to any type of projectile launching device or any device that is or simulates a projectile launching device, such as a laser tag simulated firearm. The present invention has applicability for use in security and police forces as well as "less than lethal" and "non-lethal" firearms. For ease of discussion herein, the present invention is discussed in detail in connection with paintball markers but is should be understood that the present invention can be used in connection with any type of firearm, projectile launcher and simulated versions thereof.

It is known, in the sport of paintball, that there are many different types of game play. For example, "supair or speedball": events are very close range games, played on a small field, using inflatable bunkers or similar small barricades. Typically they last a few minutes and the turnaround between games is limited to a few minutes or seconds. Such speedball games can even be played indoors. In speedball events it is preferable to have a small low profile paintball marker that is hard for a player's opponent to see and shoot at, but is quick and easy to clean the paint from between games if the player is shot during the game. Thus, for this type of game, the basic or core paintball marker is all that is needed.

On the other hand, another popular type of paintball gameplay is called a "scenario or MILSIM (military simulation)" game. Such a scenario game is played on a much larger mixed terrain field, possibly woodland or urban environment, the idea of the game is to mimic some sort of "war type scenario." Typically these games are played over a much longer period of time, normally hours or days. In scenario games many people find it preferable to have a paintball marker that you can attach various third party devices or tactical aids to, such as a fore grip, magazine, sling mounts, light sources/torches, optical sights, laser sights, cameras etc. In other words, in these types of scenario types games, it is desirable for the paintball marker to look and have the ability to accessorize more like a real firearm, such as an M16 or M4, therefore creating a MILSIM (military simulation) marker or airsoft gun.

There is a need in the prior art to enable a paintball marker (or air soft gun) to be easily and quickly converted over from its basic speedball form to a scenario or MILSIM form that includes some type of rail arrangement/system so it can more closely simulate a real firearm. As is well known, accessories, such as a light sources and scopes, are commonly mounted onto rail systems.

There have been attempts in the prior art to provide rail systems on guns and replacement mounting systems that can be interchanged on these guns. However, these devices and systems are inadequate because they do not closely simulate a real weapon or firearm because they do not completely enshroud the marker or gun. Without full or substantially full enshroudment of the underlying projectile launching device, attachment of accessories simulating a real weapon or firearm is not possible.

These prior art systems are also inadequate because they do not completely detach to leave a marker that is totally free from any rail mountings. There are shrouds or mounting systems available, but they typically attach to the barrel or to the existing rail mount.

There is a need to provide a rail kit for a paintball marker or an air soft gun that can also simultaneously easily convert the marker from a normal non-MILSIM setup to a modified scenario MILSIM set up that more closely simulates a real firearm. There is a need to provide a rail kit for a paintball marker or an air soft gun that is easy to install, remove and clean, and allows easy access to the eyes or ball detectors, without the need to remove the rail kit. There is a need to provide a rail kit for a paintball marker or airsoft gun that allows easy access to the internals of the paintball marker, without the need to remove the complete rail kit, by providing an easily removable rear cap or opening to allow removal of the internal firing mechanism for easy maintenance. There is a need to provide a rail kit for a paintball marker or airsoft gun that allows easy fitment of a stock via a quick release mechanism that may be operated with a lever latch mechanism, screw fit, bayonet fit or other mechanism. There is also a need to provide a rail kit for a paintball marker or airsoft gun that has rail mounts or the ability to mount accessory rails, such as Weaver, Picatinny or NATO rails built into the rail kit. There is a need to provide a rail kit for a paintball marker or airsoft gun that does not clamp onto, nor interfere with the barrel of the paintball marker or airsoft gun. Finally, there is a need to provide a rail kit that can receive a wide range of accessories thereon like a rail system of a real firearm.

SUMMARY OF THE INVENTION

The present invention preserves the advantages of prior art paintball markers and airsoft guns accessories added thereto. In addition, it provides new advantages not found in currently available markers, guns and accessories and overcomes many disadvantages of such currently available markers, guns and accessories.

The invention is generally directed to the novel and unique rail kit that is attached to a paintball marker, air soft gun or any other type of projectile launching device or simulated device thereof. The rail kit can quickly and easily convert a standard paintball marker or air soft gun from a conventional speedball non-MILSIM setup to a scenario or MILSIM setup that simulates the look and mounting flexibility of a real firearm. The purpose of the rail kit of the present invention is to allow the user to play 'speedball type games' and "scenario type games" with the same paintball marker by simply adding or removing the rail kit system.

In a first embodiment of the invention, the shells are formed without hinges.

In a second embodiment of the invention, at least one shell is provided with a front shell portion and a rear shell portion that are connected by a hinge that rotatably connects the front shell portion to the rear shell portion. Thus, a user can pivot the rear shell portion with respect to the front shell portion.

It is therefore an object of the present invention to provide a rail kit for a paintball marker or an air soft gun that can easily convert it from a normal non-MILSIM setup to a modified scenario MILSIM set up that more closely simulates a real firearm.

Another object of the present invention is to provide a rail kit for a paintball marker or an air soft gun that is easy to install, remove and clean.

Another object of the present invention is to provide a rail kit for a paintball marker or airsoft gun that allows easy access to the eyes or ball detectors, without the need to remove the rail kit, by providing easily removable eye cover plates.

Another object of the present invention is to provide a rail kit for a paintball marker or airsoft gun that allows easy access to the internals of the paintball marker, without the need to remove the complete rail kit, by providing an easily removable rear cap or opening to allow removal of the internal firing mechanism, such as for easy maintenance or any other purpose.

Another object of the present invention is to provide a rail kit for a paintball marker or airsoft gun, projectile launcher or simulation thereof that allows easy fitment of a stock via a quick release mechanism that may be operated with a lever latch mechanism or any other type of mechanism.

Another object of the present invention is to provide a rail kit for a paintball marker or airsoft gun that has rail mounts such as Weaver, Picatinny or NATO rails built into the rail kit.

Another object of the present invention is to provide a rail kit for a paintball marker, airsoft gun, projectile launcher or simulation thereof that has the ability to mount accessory rails such as Weaver, Picatinny, NATO rails, dovetail rail or other rail system onto the rail kit.

Another object of the present invention is to provide a rail kit for a paintball marker or airsoft gun that does not clamp onto, nor interfere with the barrel of the paintball marker or airsoft gun. Therefore allowing the barrel to be removed without the need to remove the complete rail kit. For example, optionally, the regulator, frame, feed neck can be removed where the rail kit does not interfere of clamp onto these components.

A further object of the present invention is to provide a rail kit that can receive a wide range of accessories thereon like a rail system of a real firearm.

A further object of the present invention is to provide a rail kit that has a front shell portion and a rear shell portion connected by a hinge, so that a user can selectively rotate the rear portion with respect to the front portion to access the underlying marker.

A further object of the present invention is to provide a rail kit with a rear shell portion that is detachable from a front shell portion at a hinge when the front shell portion is secured to a projectile launching device.

BRIEF DESCRIPTION OF THE DRAWINGS

The novel features which are characteristic of the present invention are set forth in the appended claims. However, the invention's preferred embodiments, together with further objects and attendant advantages, will be best understood by reference to the following detailed description taken in connection with the accompanying drawings in which:

DETAILED DESCRIPTION OF THE PREFERRED EMBODIMENT

FIGS. 1-11 show a first embodiment of the rail kit of the present invention.

The add-on mounting rail kit 10 is designed to be simple to add or remove from a paintball marker 11, thus enabling the player to enjoy all types of paintball games with the same paintball marker 11. This negates the need for the player to have to buy two guns to play all types of the game, saving the player a great deal of money.

Figure 1:
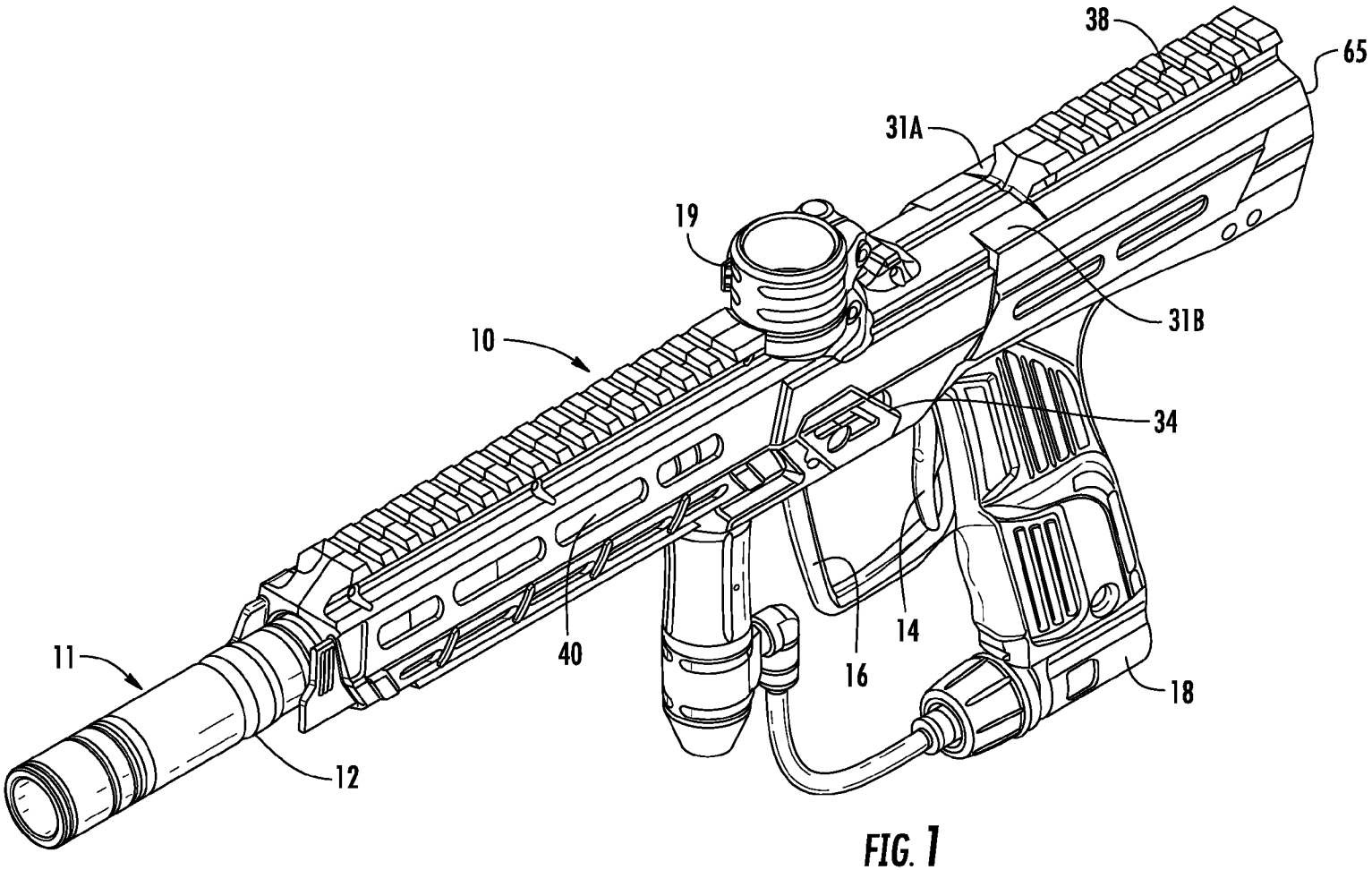
FIG. 1 is a perspective view of a first embodiment of the rail kit of the present invention installed on a standard paintball marker.
Figure 2:
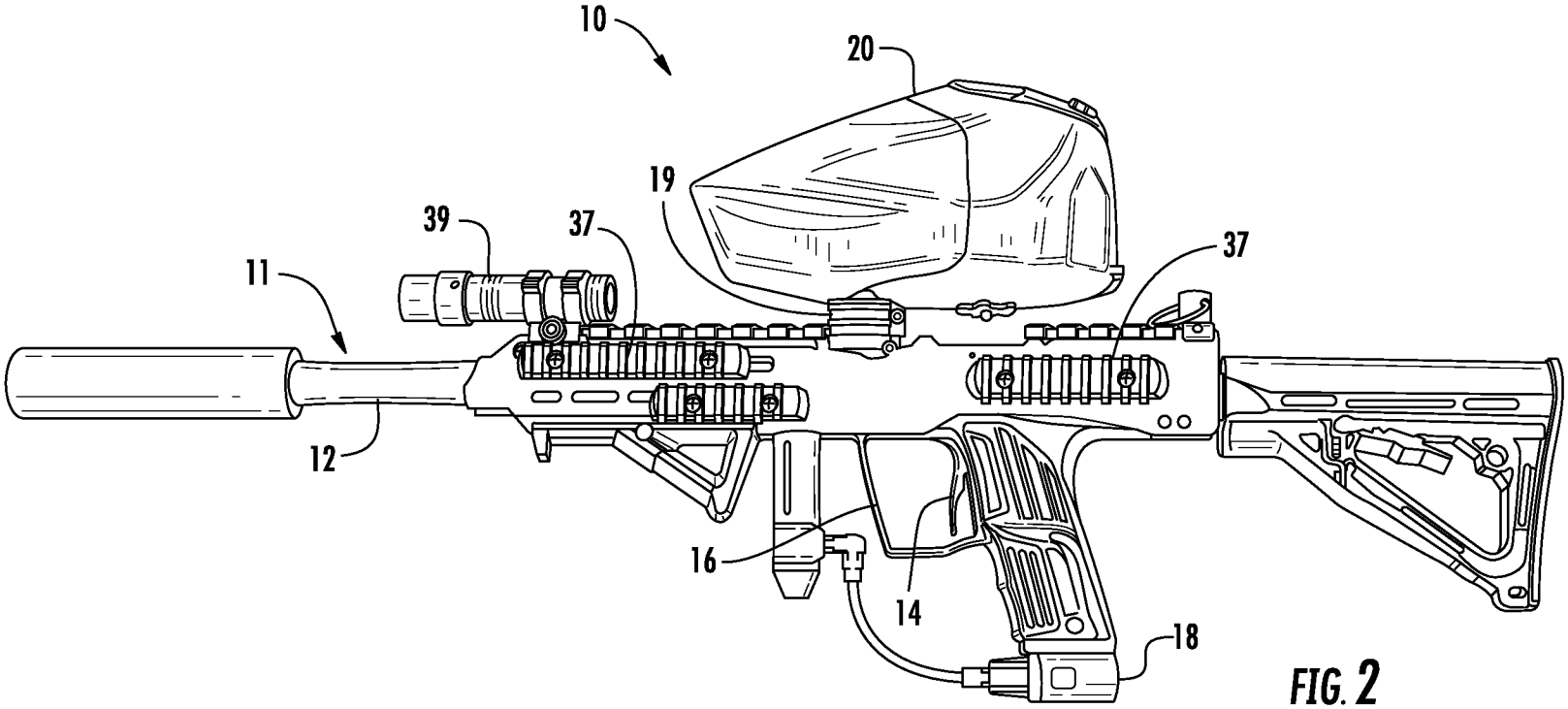
FIG. 2 is a side elevational view of a marker equipped with a first embodiment of the rail kit of the present invention with some accessories installed on the rail system.
Figure 3:
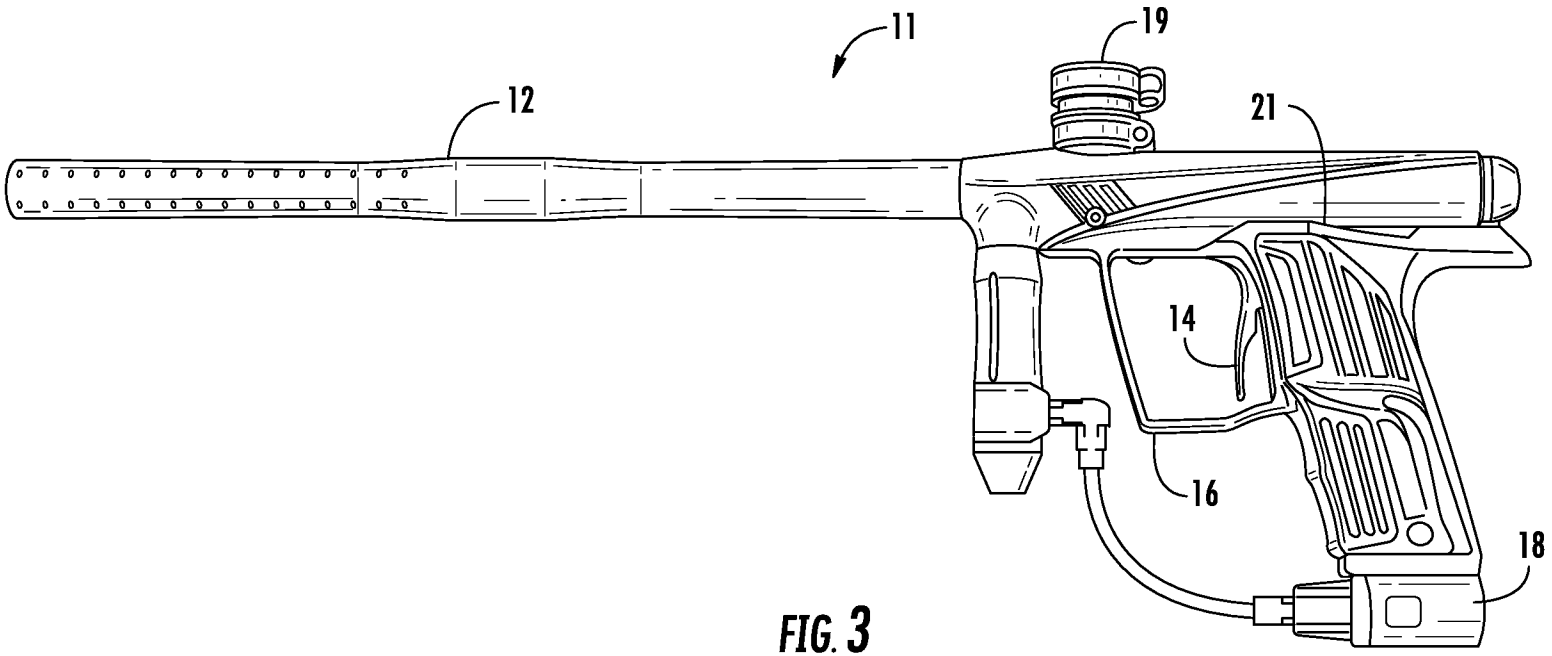
FIG. 3 is a standard type paintball marker, without the rail kit of the present invention installed, that could be used in speedball non-MILSIM type paintball games.
Figure 4:
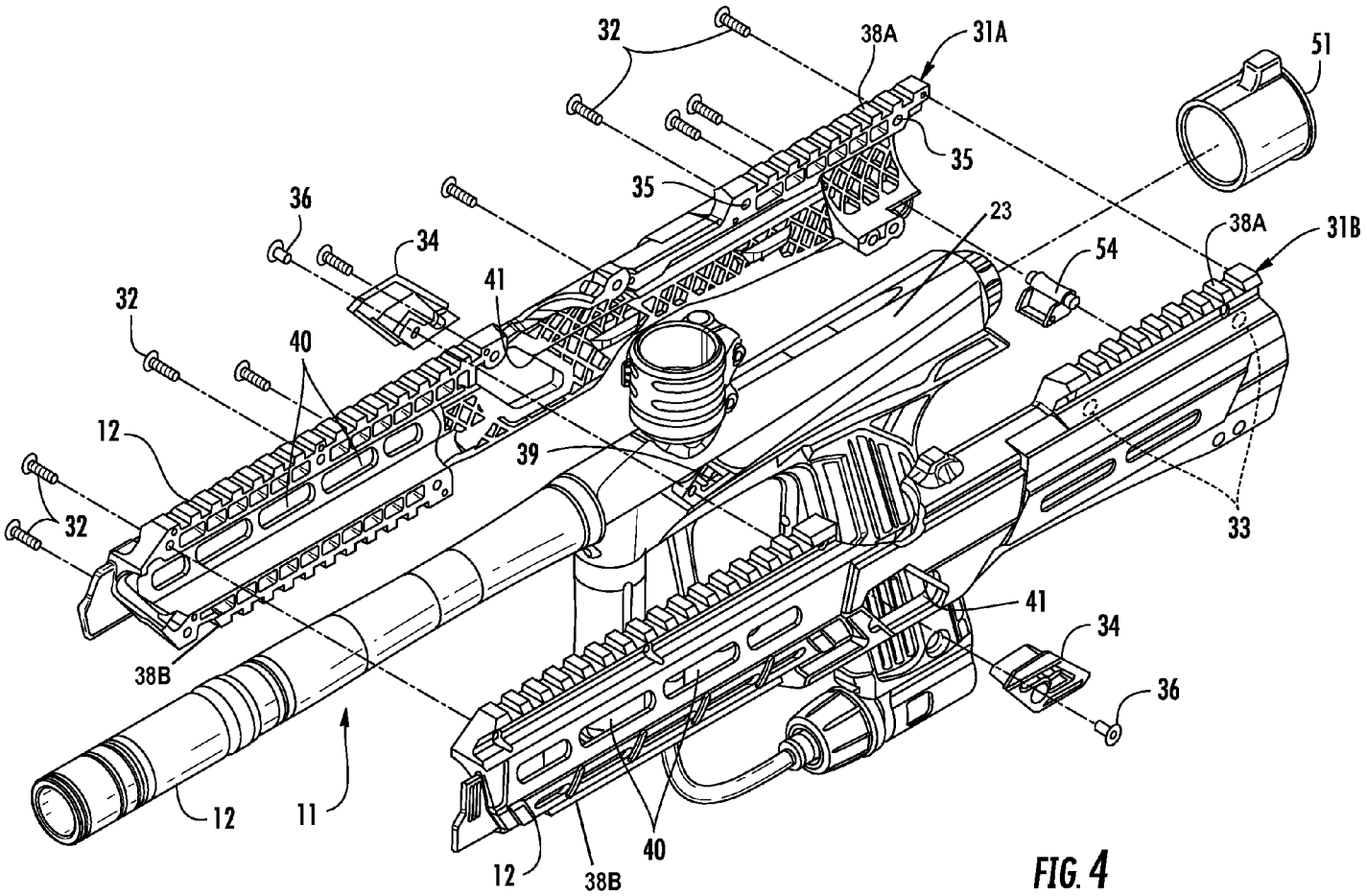
FIG. 4 is an exploded perspective view of a first embodiment of the paintball marker of FIG. 3 with the rail kit of the present invention shown enshrouded thereabout in exploded fashion along with a blanking plug, which is retained in place by a lever latch lock system.

The construction of the rail kit 10 of the present invention can be seen best in connection with FIGS. 1, 2 and 4. The uniqueness of the present invention is directed to the rail kit 10 providing a substantially full shroud about the underlying marker 11 (such as seen in FIG. 3) to convert its exterior configuration to a scenario MILSIM type marker, as seen in FIGS. 1 and 2.

An example of an underlying marker 11 is shown in FIG. 3. The marker 11 has a barrel end 12 and a handgrip end 16. The handgrip end 16 has a trigger 14 and a gas tube receiver 18 for receiving compressed gas from a tank (not shown) to operate the paintball marker 11. The marker 11 also has notches 21 on the outer surface of the marker 11 and contact points 23 on the upper surface of the marker 11. These notches 21 and contact points 23 help secure mounting of the conversion kit 10 of the present invention. On the upper surface of the marker 11 is a paintball receiver 19 capable of engaging a paintball hopper 20, as seen in FIG. 2. Other hoppers, magazines and paintball feeding mechanisms could be mounted on or under the conversion kit 10 in order to provide paintballs to the marker, in accordance with the present invention.

FIG. 1 shows the conversion kit 10 of the present invention enshrouding or covering the underlying marker 11 while still allowing the user to access and inspect features, parts and components of the marker 11, such as the trigger 14, the gas tube receiver 18, the paintball receiver 19, and the barrel 12 without removing the conversion kit 10 from the marker. Thus, even when the conversion kit 10 is installed on the marker 11, the operation of the underlying marker 11 remains unaffected and the marker 11 operates in a normal fashion.

The conversion kit 10, shown in FIG. 1, preferably has two shells 31A, 31B that are secured on the marker 11. While two shells are preferred, it is envisioned that the conversion kit 10 may include more than two shells, such as where multiple shells are secured about each side of the marker 11. These variations in the configuration of the shells are considered to be within the scope of the present invention.

Referring to FIG. 4, for example, the shells have apertures 40 through the sides of the shells 31A, 31B and a rail system 38A formed on the upper surfaces of the shells and rail system 38B on the lower surface of the shells 31A and 31B. It should be noted that the tops of the shells 31A and 31B are show to respectively provide a partial rail system. When the shells 31A and 31B are mated together, as in FIG. 1, they form, together, a full rail system of a desirable width. It is also possible that the rail system is provided on only one of the shells. It is also possible that the rail system is provided on any surface of the shells. Further apertures 41 are also preferably provided to receive eye covers 34, which are secured by fasteners 36. This enables access to important components on the marker 11.

FIG. 2 also shows that additional side rails 37 may be mounted on the apertures of the conversion kit. These features both give the marker an appearance that is more similar to a real firearm. Furthermore, the rail system 38 and side rails 37 each allow the user to mount objects to the marker with the conversion kit 10. For example, FIG. 2 shows a light 39 that is mounted to the rail system 38 of the conversion kit 10. A user could also mount other objects, such as a laser sight, an optical sight, a scope, a magazine or other firearm accessories. Although the rail system, collectively 37 and 38, shown in the figures resembles a common rail system design, other rail systems are also possible. Also, although the figures show a rail system 38 on the upper surfaces of the shells and side rails 37, in other embodiments, the rail system may be provided on a lower, or any surface of the shells, such that objects could be mounted directly below or on any surface of the shells 31A, 31B.

FIG. 4 shows the shells 31A, 31B have removable eye cover plates 34 that allow easy access to ball detectors 39, without the need to remove the rail kit 10. As shown in FIG. 1, the eye cover plates 34 are removably fastened to the shells 31A, 31B using cover plate fasteners 36. In FIG. 1, these cover plate fasteners 36 are shown as threaded fasteners, but a person of ordinary skill in the art could use other fastening methods.

Figure 5:
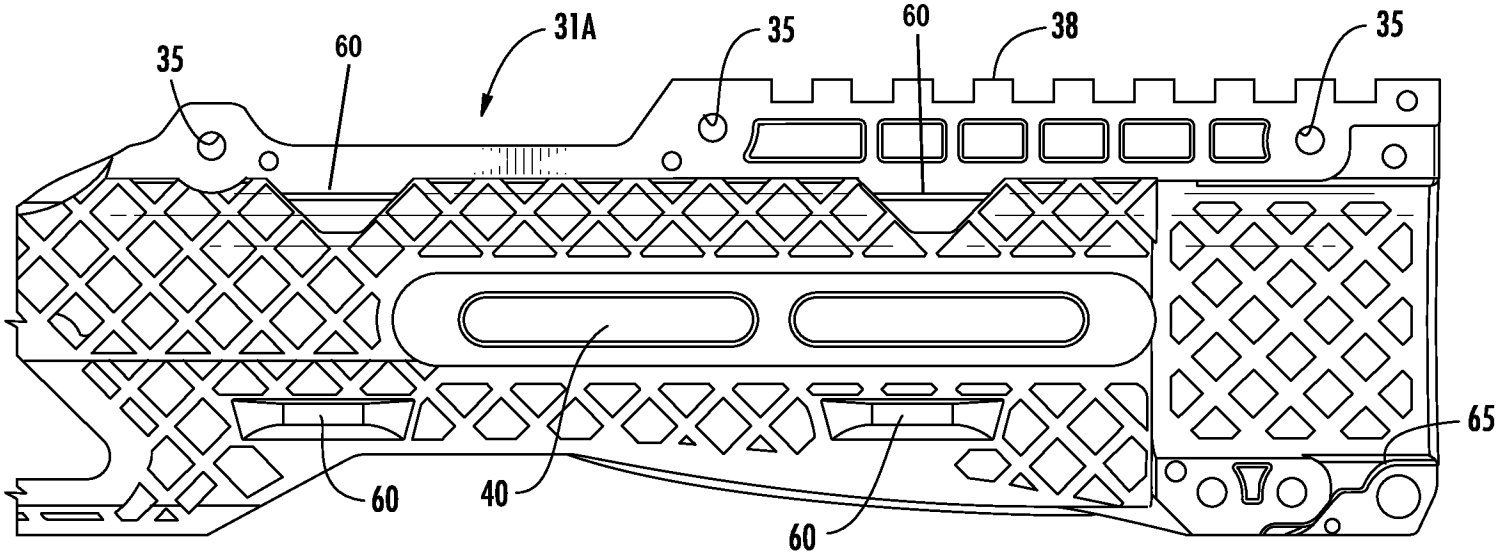
FIG. 5 is one of the half-shells of a first embodiment of the rail kit of the present invention showing contact points.
Figure 6:
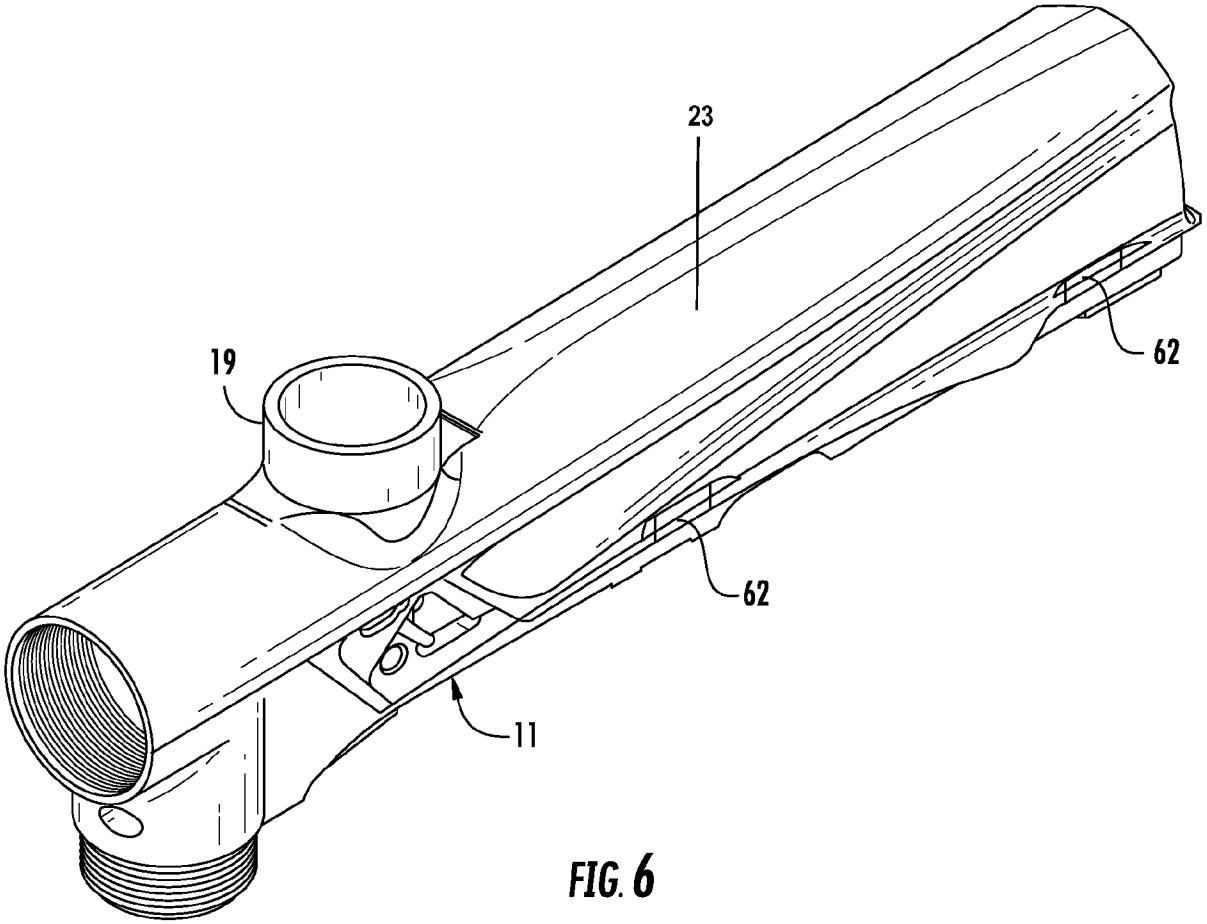
FIG. 6 a shows contact points between an underlying paintball marker and a first embodiment of the shell (as in FIG. 5), when fully assembled, such as shown in FIG. 1.

FIGS. 4-6 show how the shells 31A, 31B (preferably two half shells) are secured onto and about the body of the marker 11. It is envisioned that the two half shells 31A, 31B can be retained together by any means possible. For example, it is possible to retain the shells together by a fastener, such as a screw 32 and retained nut arrangement. FIG. 4 shows male threaded screws 32 routed through pass through holes 35 on one shell 31A and into female threaded holes 33 on the other shell 31. Other possible ways to retain the shells together could be cable ties, clips, ratchets and any other structure envisioned including any of those envisioned by a person of ordinary skill in the art.

FIGS. 4-6 show the contact points between an underlying paintball marker 11 and the shells 31A and 31B, particularly as in FIG. 5 when fully assembled. The contact points are between the protrusions 60 on the shells, as in FIG. 5, and seats (or surfaces) 62, as in FIG. 6, on the marker 11 itself. The communication between the contact points 60 into and onto seats (or surfaces) 62 help key and align a given shell, 31A, 31B to the marker 11. It should be understood that the communication and keying of the shells 31A, 31B to the marker 11 is just one example. The communication can be reversed where the protrusions are on the marker 11 and the recessed seats are on the shells 31A, 31B. Any other complementary contact surface mate between a marker 11 and the shells 31A, 31B can be employed and still be within the scope of the present invention.

These contact points are an integral part of the attachment method around the body giving the clamping sections stability when the mating pads or protrusions 60 on the inner surface of the shell 31A, 31B, as in FIG. 5, are inserted into or onto the notches or seats (or surfaces) 62 and put under tension. This tension is caused by the pads or protrusions (that can be solid or made from a soft foam or rubber material) 60 that push on the upper section of the marker body (FIG. 5). Although these figures show one arrangement of protrusions and notches, there is scope for many contact points or indeed for the whole surface to be a contact point, a wide variety of arrangements are possible and are considered to be covered by this invention.

Although the conversion kit 10 is shown as including two shells in the figures, the conversion kit could also be formed of a single shell. For example, a shell could be formed as a single piece that is capable of being placed around a marker. A flexible portion or a hinged portion on the single shell would allow a single shell to completely enshroud the marker 11. Another example of a single shell would be a shell that provides an upper shroud for a marker and has an aperture in the lower surface of the shell for receiving a marker. Single shell embodiments such as these would allow the user to more quickly convert the marker to a MILSIM type marker, and also provide a conversion kit that more closely simulates a real firearm.

Figure 7:
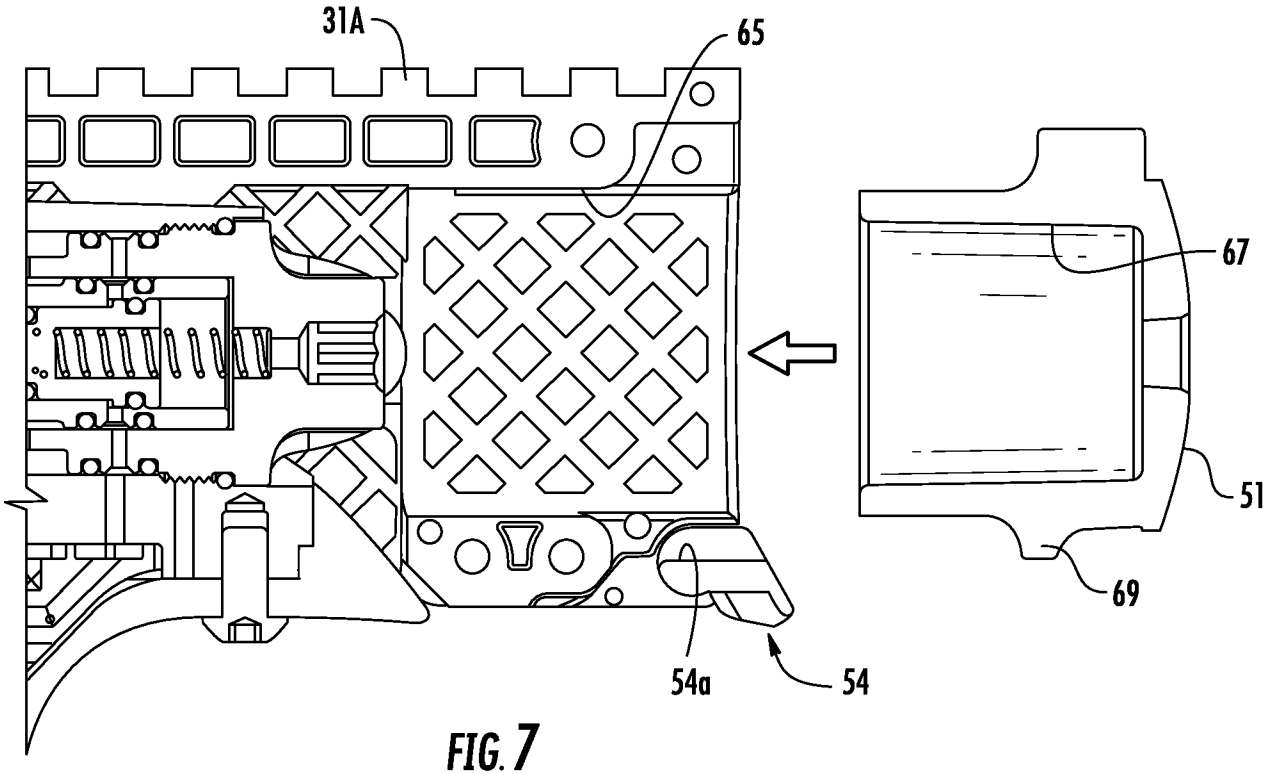
FIGS. 7-10 show the process of installing a blanking plug in the rear of a first embodiment of the rail kit of the present invention as retained by a lever lock latching system, one of the shells being removed for illustration purposes.
Figure 8:
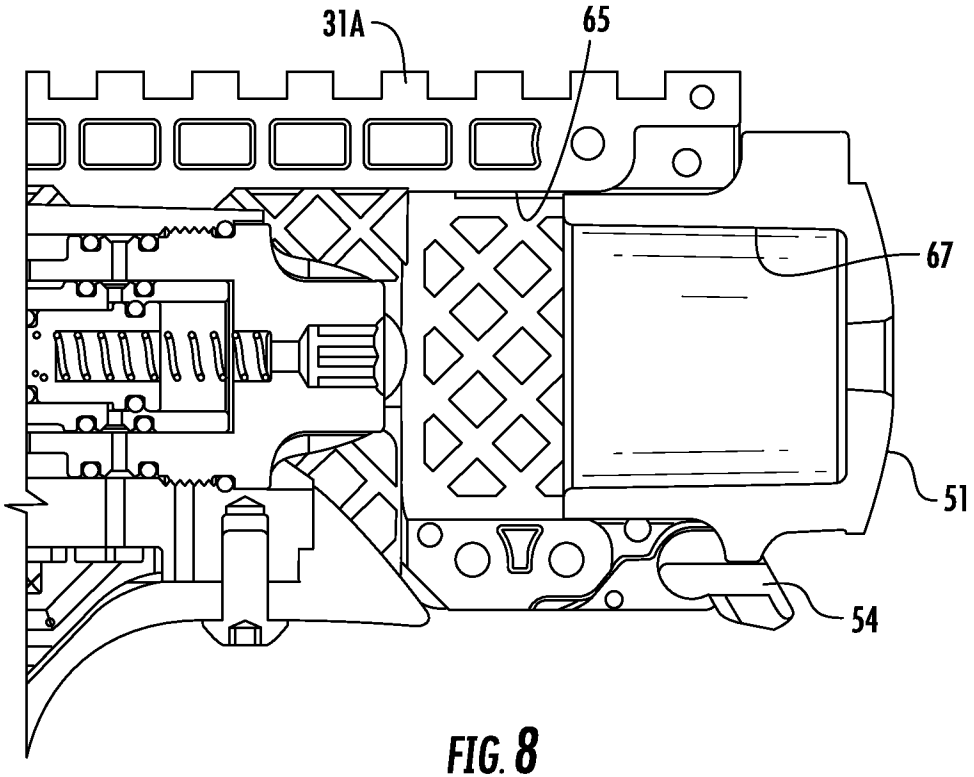
Figure 9:
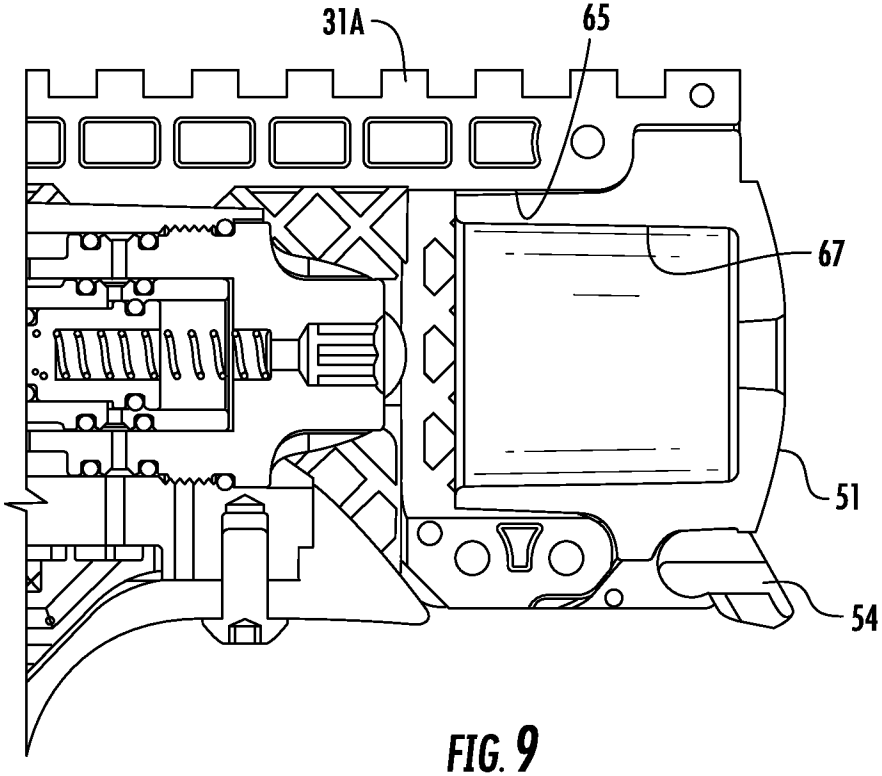

When the two shells 31A, 31B are mated together and enshrouding the marker 11, they leave a rear open end 65. This open end 65 can be either closed up or have an accessory mounted therein. A unique lever latch system, employing a locking latch lever 54 preferably pivotally mounted to one or both of the shells 31A, 31B, as seen in FIGS. 7-11, is integral to the rear open end of the conversion kit 10. More specifically, a blanking plug 51 (FIGS. 7-10) is receivable into the rear open end 65. In FIG. 7, where shell 31B is not shown for illustration purposes, it can be seen that open end 65 is rearwardly facing. Plug 51 is configured to be complementary in shape to the open end. The plug 51 is directed into the rear open end 65, as shown by the arrow. During which time, lever 54 is set in an open position, as seen in FIG. 7. This permits the plug 51 to be easily routed into the rear open end 65. More specifically, tab 69 of plug 51 can easily pass over notch 54*a* of lever 54. In FIG. 8, the plug 51 is shown partially installed into the rear open end 65 with FIG. 9 showing the plug 51 fully installed. It should be noted that its is possible that the plug is not solid but open inside to define opening 67 to permit optional actuation of components of the marker 11, such as a firing pin, bolt or the like (not shown).

Figure 10:
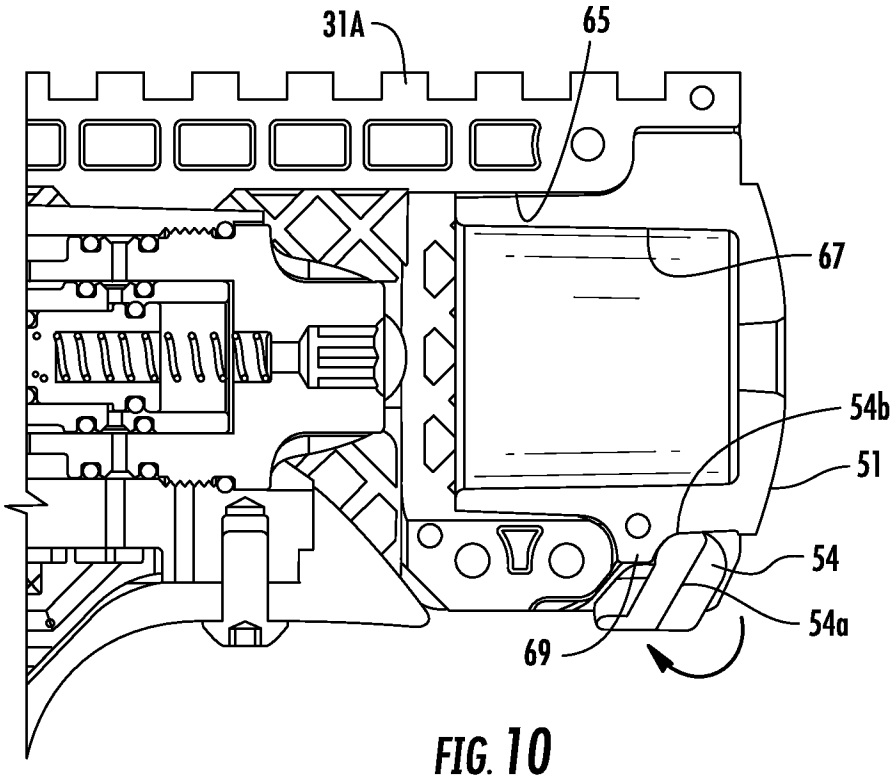

FIG. 10 shows the plug 51 fully installed and seated in place in the rear open end 65 with the lever 54 rotated clockwise in the direction of the arrow shown to locate stop portion 54*a* of the lever 54 directed behind tab 69. As a result, plug 51 is secured in place and is prevented from moving rearward out from the rear open end 65.

Figure 11:
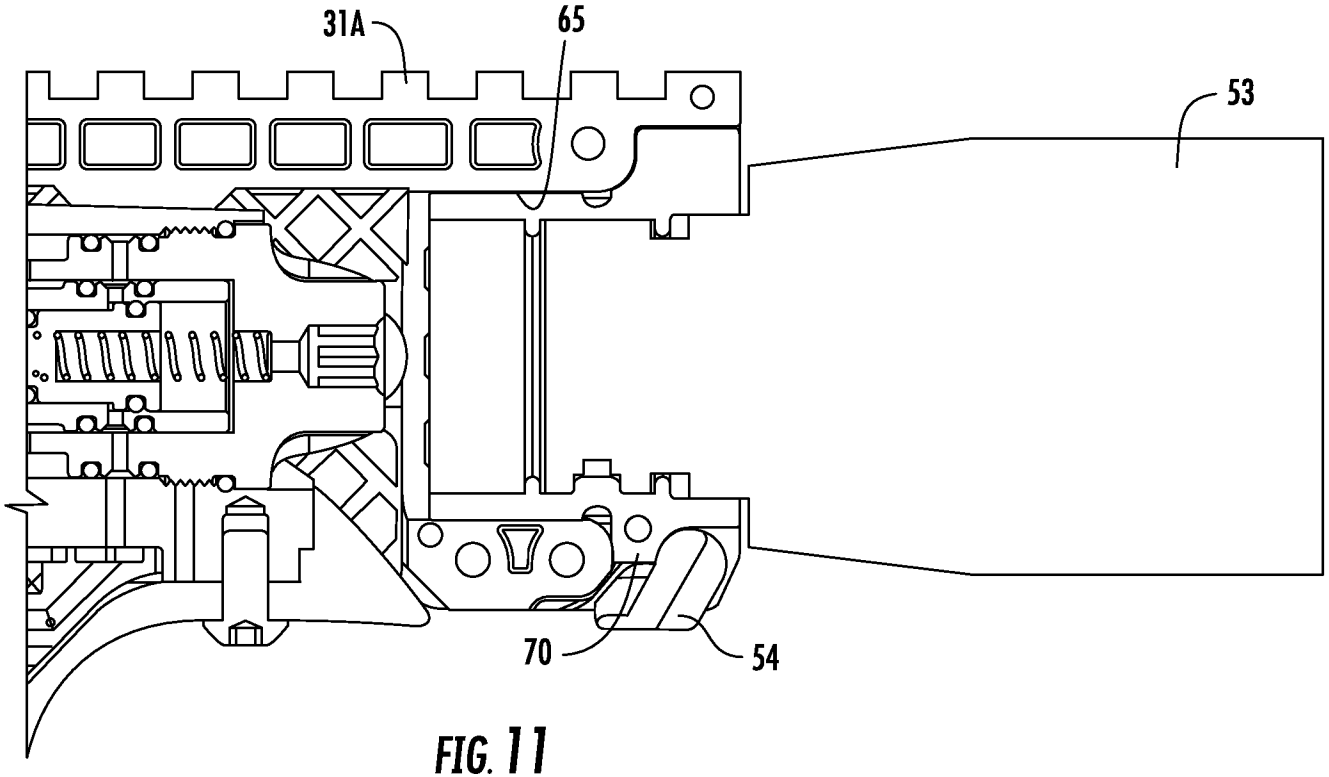
FIG. 11 shows a butt stock, as in FIG. 2, installed in place and retained by the lever lock latching system, one of the shells being removed for illustration purposes.

Turning now to FIG. 11, as an alternative and as another example of an accessory that can be installed in the rear open end 65, a butt stock 53 is shown installed. Such installation still allows the simple quick access to the internals of the paintball marker without removing the whole rail kit 10. The butt stock includes a forward portion this is received in the rear open end 65 in similar fashion to the forward portion of the plug 51. Similarly, a tab 70 is provided on the butt stock 53 to engage with lever 54. Once the butt stock is installed and residing the open end 65, the lever latch 54 is rotated to lock the butt stock 53 in place, as seen in FIG. 11. Further figures are not included herein to show the butt stock 53 unlocked because it is, essentially, the same as how the plug 51 is shown unlocked in FIGS. 7-9.

Although the invention is shown as having a lever 54 to secure the accessories inserted into the rear of the conversion kit 10, the conversion kit 10 could use other retention devices. For example, a user could secure a blanking plug 51 or butt stock 53 in the rear of the conversion kit 10 using cable ties, clips, ratchets, screw thread, bayonet fitting and any other structure envisioned including any of those envisioned by a person of ordinary skill in the art.

In view of the foregoing, a new and novel rail kit system and conversion kit 10 is provided that can easily convert a standard paintball marker or air soft gun 11 from a speedball non-MILSIM setup with no rail system to a scenario MILSIM type setup where a rail kit 31A, 31B fully enshrouds the marker or gun 11 to better simulate a real MILSIM firearm and provide a rail system 38 for receipt of accessories thereon.

The rail kit 10 of the present invention may be made out of any suitable material and manufactured in many different ways. For example, the rail kit 10 may be molded out of plastic or machined from metal, such as aluminum. Any such material and method of manufacture is considered within the scope of the present invention.

FIGS. 12-28C show a second embodiment of the rail kit of the present invention.

Generally, the second embodiment of the conversion kit of the present invention includes at least one shell, each shell having a front shell portion and a rear shell portion that are rotatably connected to each other at a hinge. The front shell portion is releasably securable to a projectile launching device, and the rear shell portion is releasably securable to the front shell portion by selective engagement of the hinge. A user can selectively rotate the rear shell portion with respect to the front shell portion between a lowered orientation and a raised orientation. A user would typically rotate the rear shell portion to the lowered orientation (see FIGS. 12-13) when using the projectile launching device to launch projectiles. A user can then selectively rotate the rear shell portion to the raised orientation (see FIGS. 25A-25B) to access features of the underlying projectile launching device to which access is obstructed when the rear shell portion is in the lowered orientation.

Figure 12:
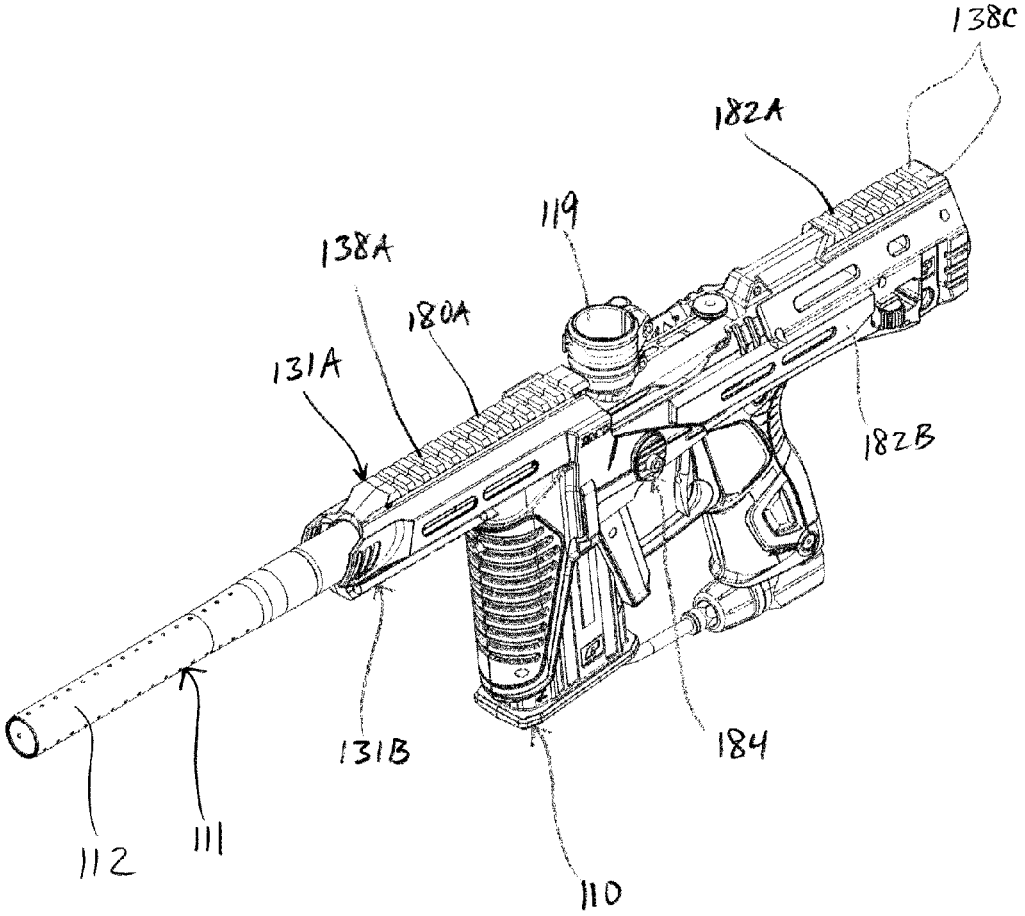
FIG. 12 shows a perspective view of a second embodiment of the rail kit of the present invention installed on a standard paintball marker.
Figure 13:
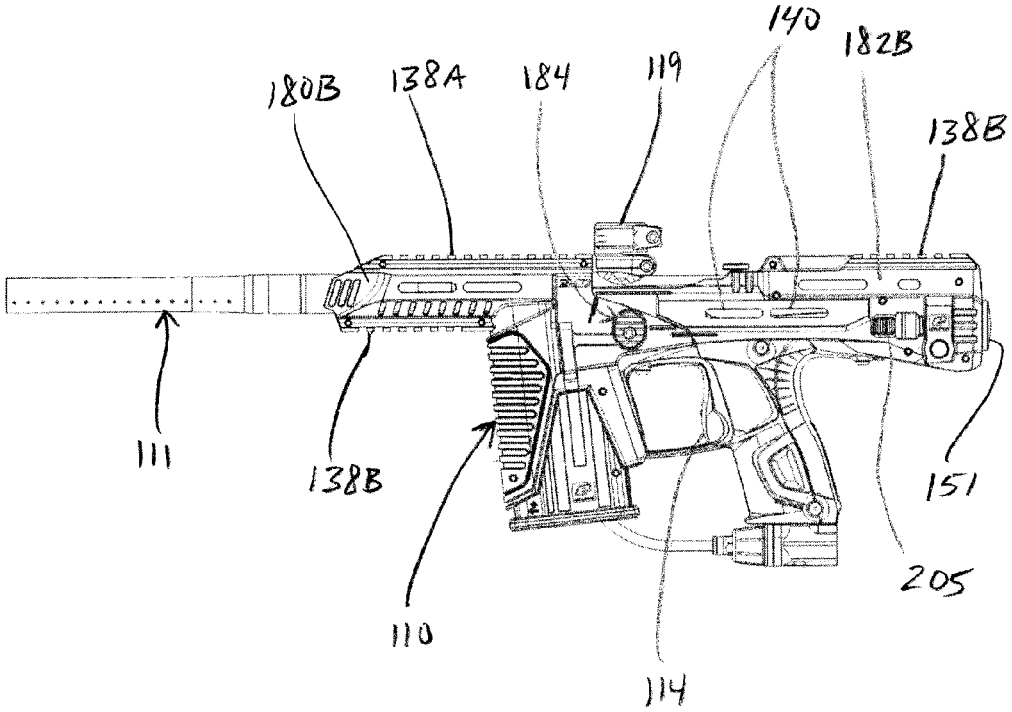
FIG. 13 shows a side view thereof.
Figure 14:
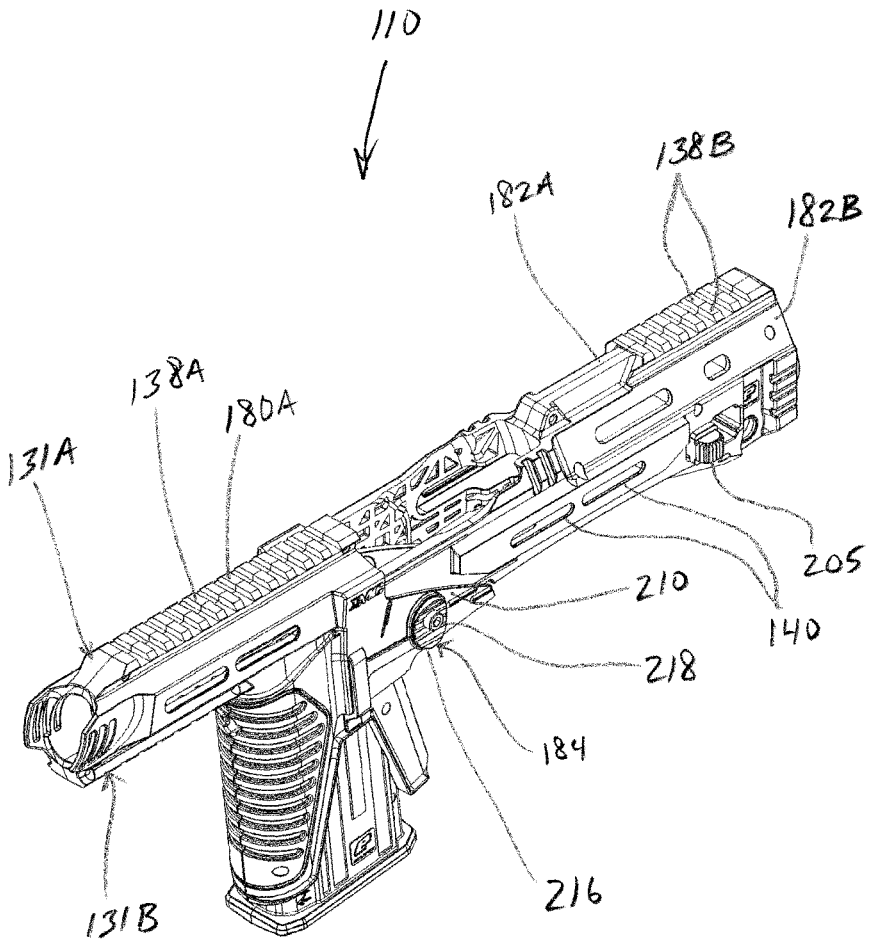
FIG. 14 shows a perspective view of the second embodiment assembled, without a paintball marker.

Turning now to the figures, FIGS. 12 and 13 show the second embodiment of the conversion kit 110 of the present invention as it may be provided to a user already secured to a paintball marker 111. FIG. 14 shows the second embodiment of the conversion kit 110 of the present invention, as it may be provided to a user separately from a projectile launching device so the user can then secure the conversion kit 110 to a projectile launching device, such as a paintball marker 111. As seen in FIGS. 12-13, similar to the first embodiment, the second embodiment of the conversion kit 110 is capable of enshrouding or covering the underlying marker 111 while still allowing the user to access and inspect features, parts and components of the marker 111, such as the trigger 114, the gas tube receiver 118, the paintball receiver 119, and the barrel 112 without removing the conversion kit 110 from the marker 111. Thus, even when the second embodiment of the conversion kit 110 is installed on the marker 111, the operation of the underlying marker 111 remains unaffected and the marker 111 can be operated in a normal fashion.

The second embodiment of the present invention can be provided to a consumer as either a conversion kit 110 that is provided separately from a projectile launching device 111, or the present invention can be provided as a system that includes the conversion kit 110 and a projectile launching device 111.

In the second embodiment, the conversion kit 110 includes at least one shell that is capable of being secured on a projectile launching device. In the case of a single shell, there is a single front shell portion and a single rear shell portion. The front shell portion and the rear shell portion are rotatably connected at a hinge so that the rear shell portion may pivot about the hinge with respect to the front shell portion when the front shell portion is secured to a projectile launching device. In the case of one shell, the front shell portion and the rear shell portion respectively take the place of the front shell assembly and the rear shell assembly that are made up of front shell portions in the case discussed in more detail below where there is more than one shell.

Figure 15A:
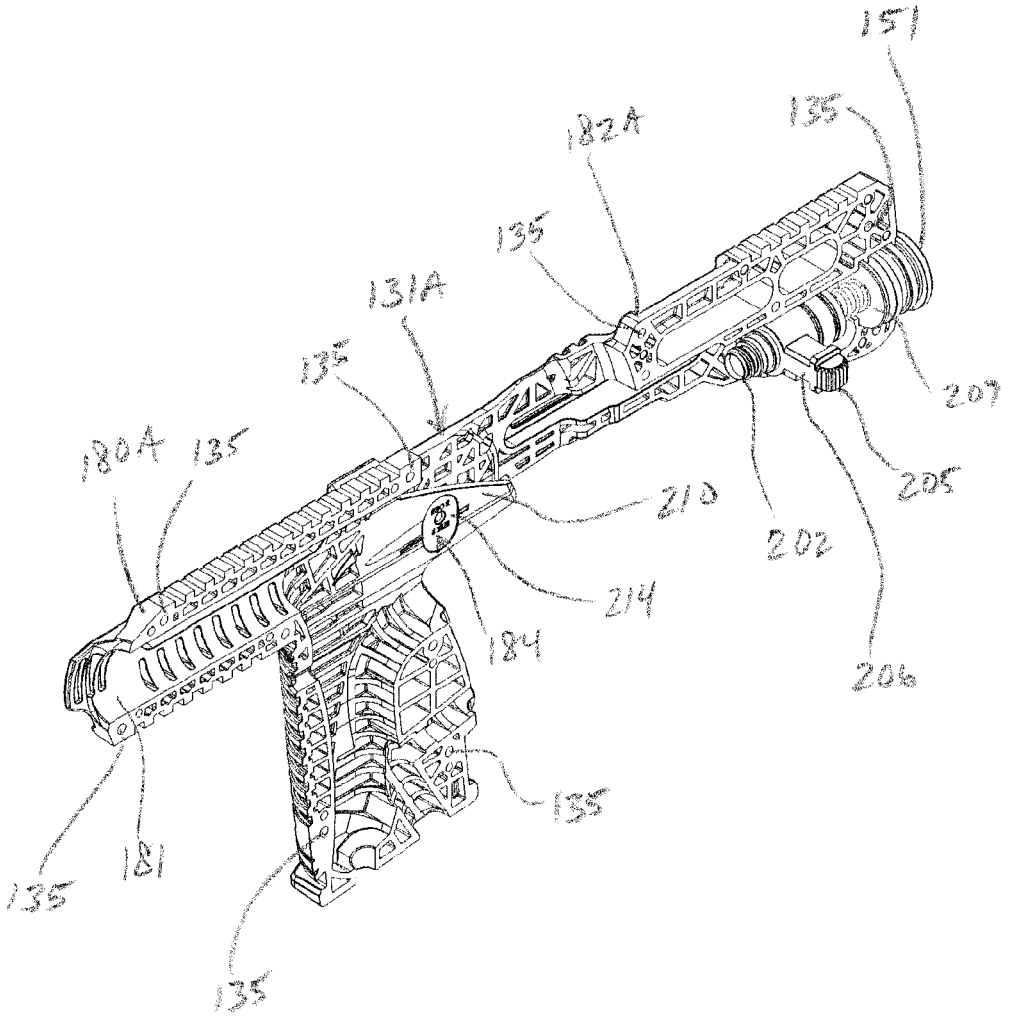
FIG. 15A shows a perspective view of a first front shell portion thereof and a first rear shell portion thereof.
Figure 15B:
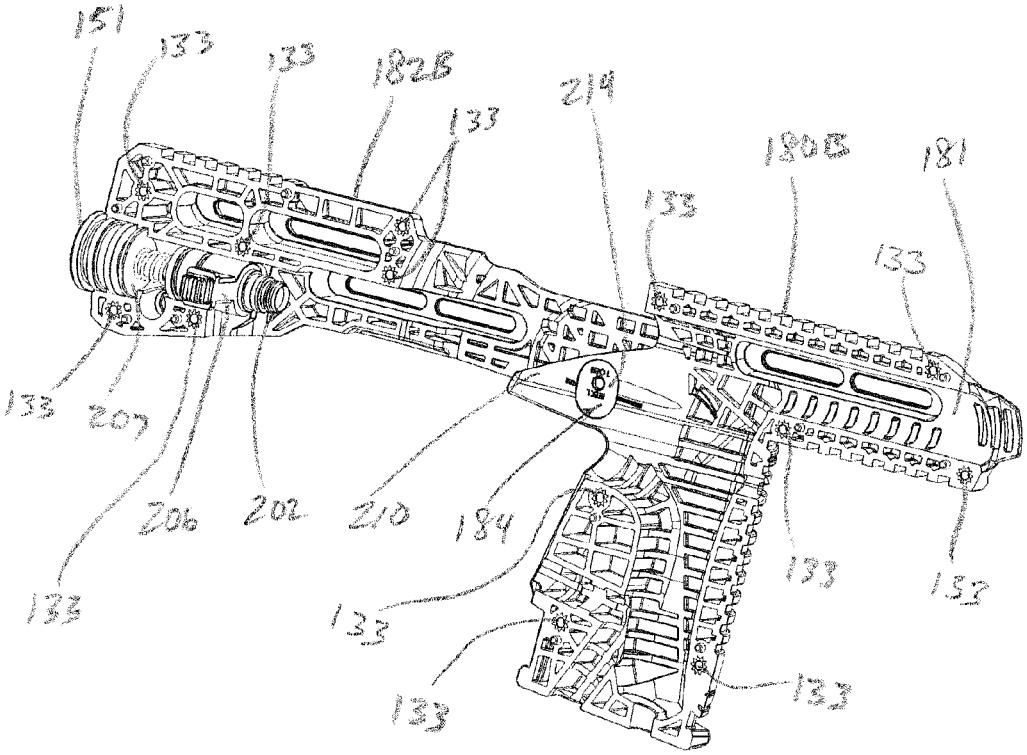
FIG. 15B shows a perspective view of a second front shell portion thereof and a second rear shell portion thereof.
Figure 16:
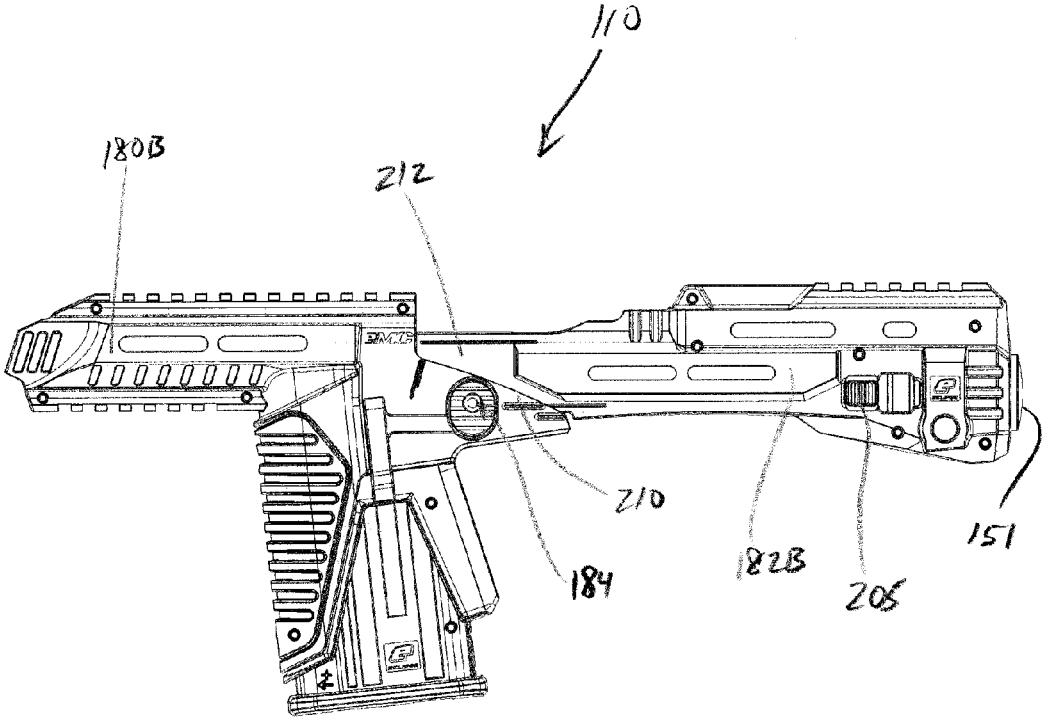
FIG. 16 shows a side view of the embodiment of FIG. 14.
Figure 17:
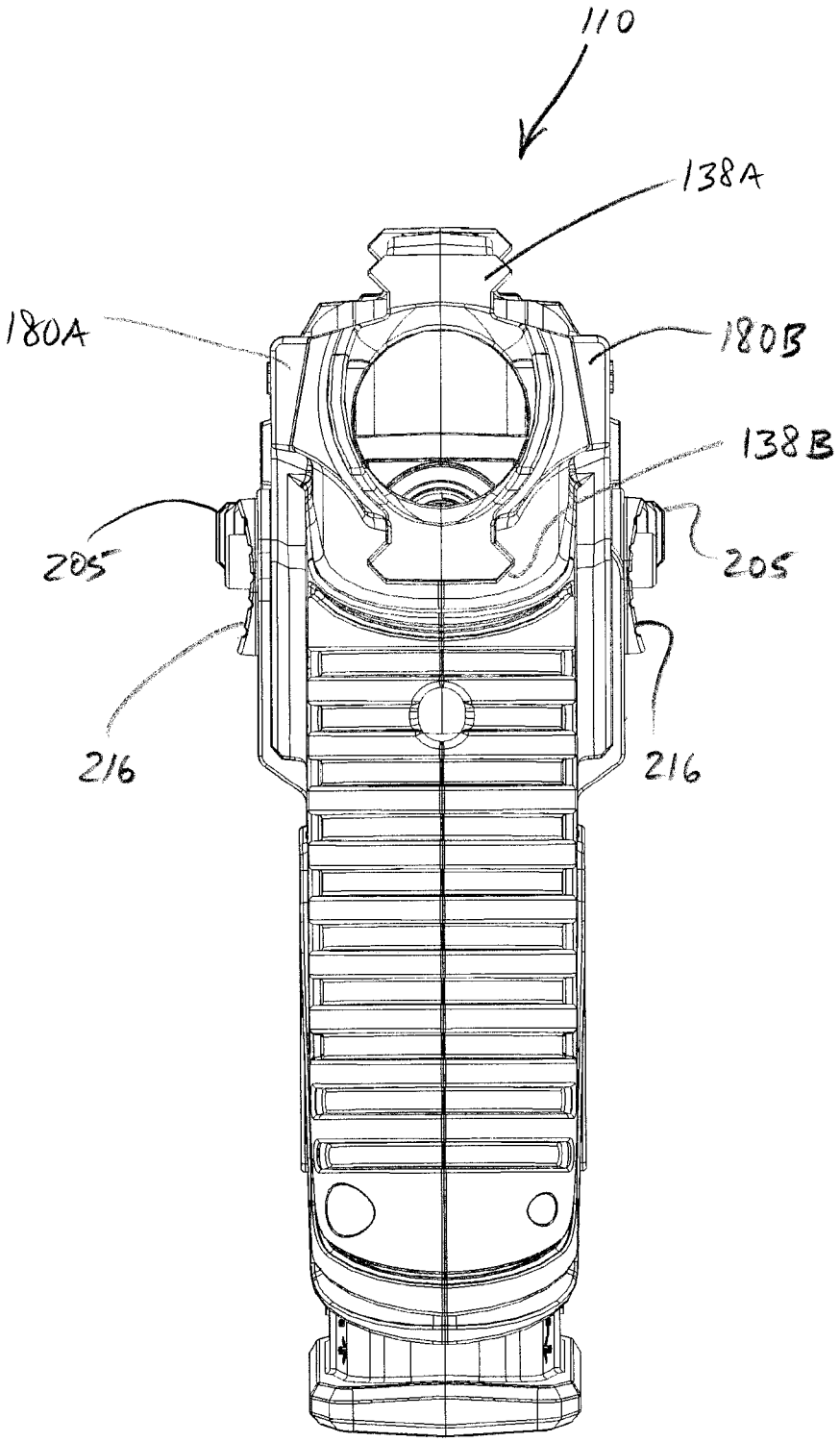
FIG. 17 shows a front view thereof.
Figure 18:
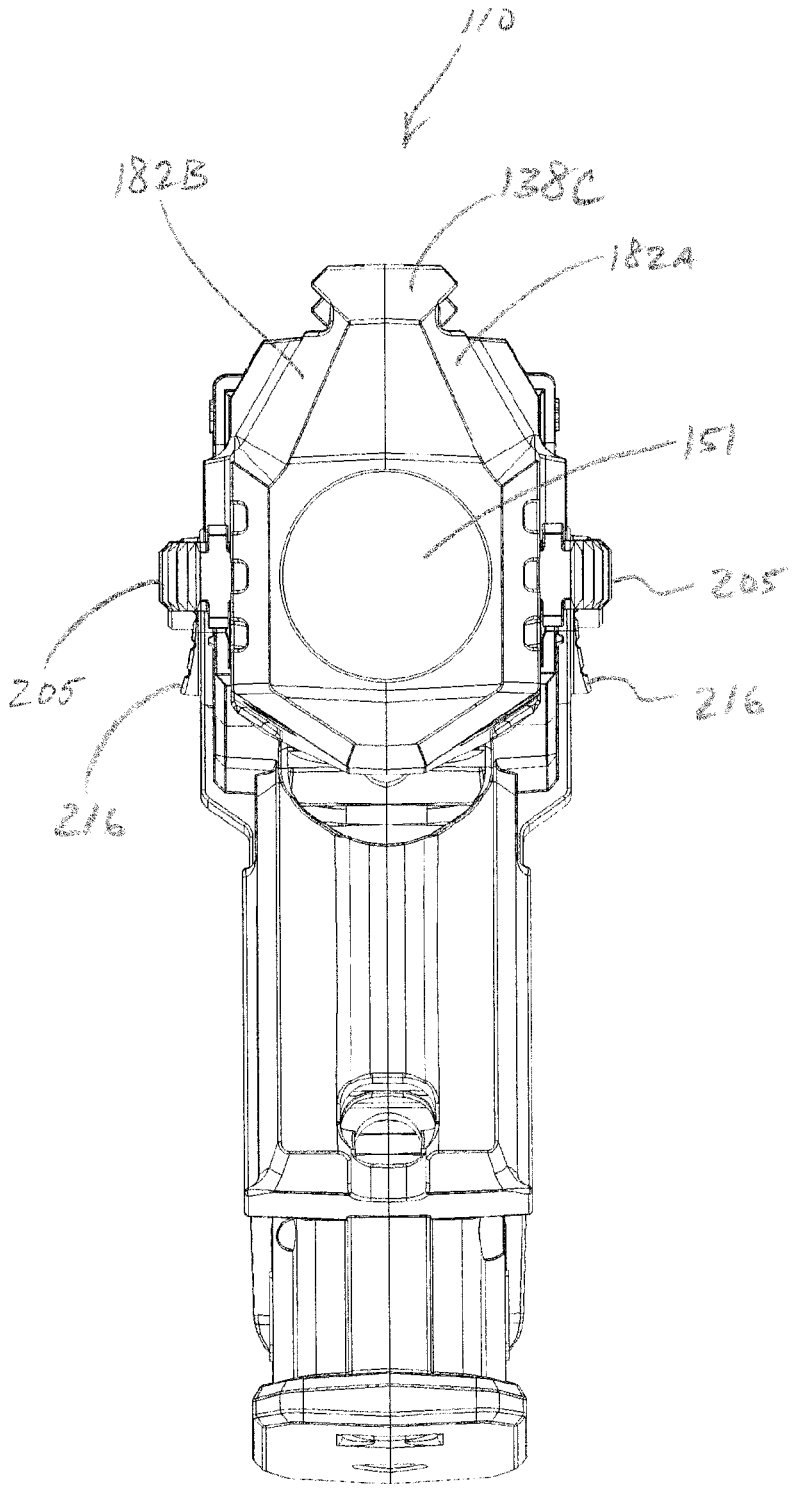
FIG. 18 shows a rear view thereof.
Figure 19:
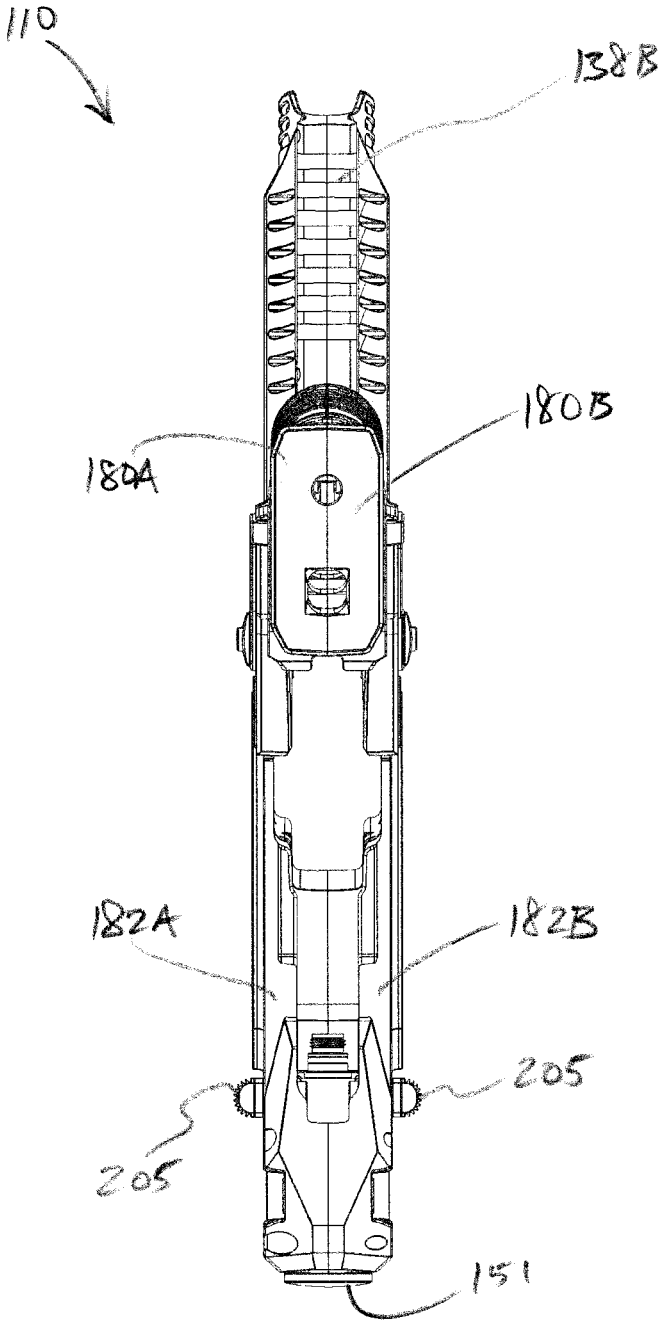
FIG. 19 shows a bottom view thereof.
Figure 20:
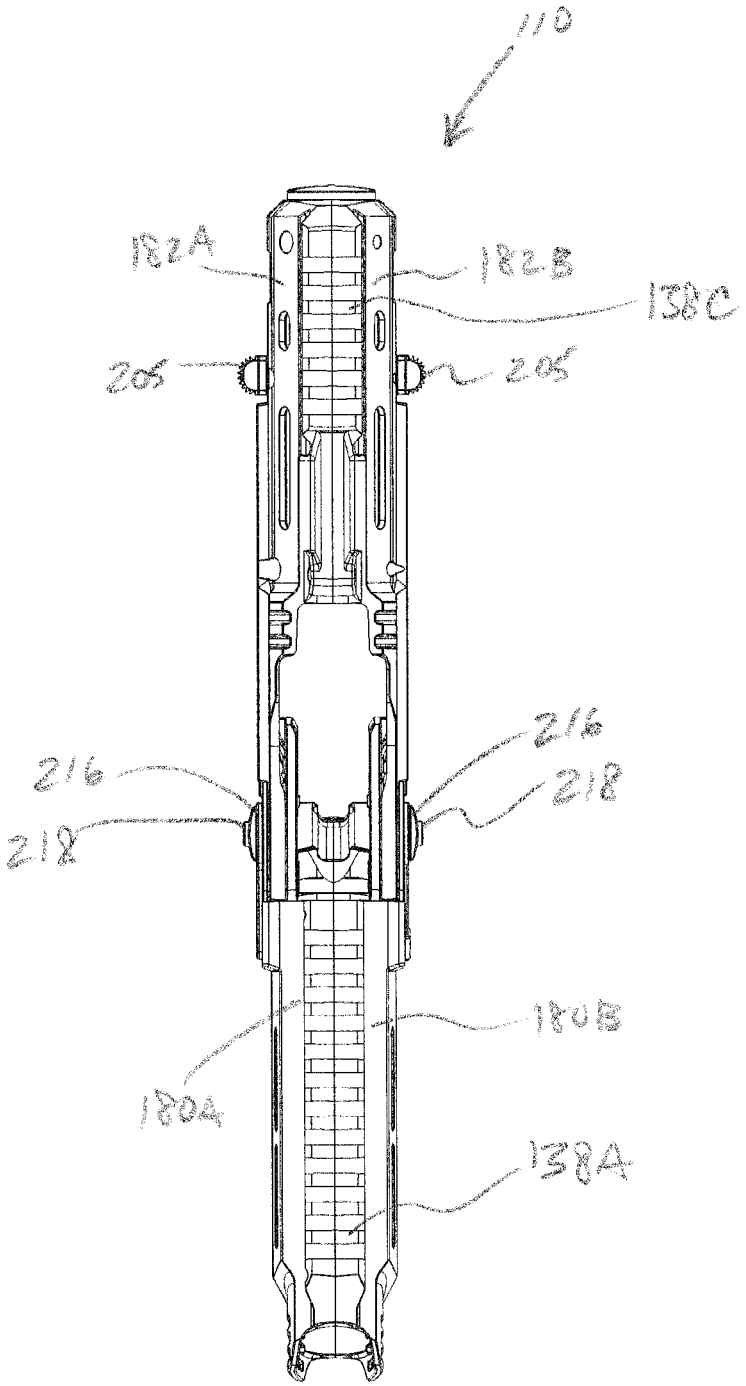
FIG. 20 shows a top view thereof.

In the case of more than one shell, as shown in the embodiment of FIG. 12, the plurality of shells 131A, 131B cooperate to form a front shell assembly and a rear shell assembly. For example, a first shell 131A includes a first front shell portion 180A and a first rear shell portion 182A, and a second shell 131B includes a second front shell portion 180B and a second rear shell portion 182B, as shown in FIG. 15A and FIG. 15B. When the conversion kit 110 is assembled, the first front shell portion 180A and the second front shell portion 180B are mated together and secured by fasteners, and the first rear shell portion 182A and the second rear shell portion 182B are mated together and secured by fasteners, so that the first and second front portions 180A, 180B are spatially fixed relative to each other, and the first and second rear portions 182A,182B are spatially fixed relative to each other, as shown in FIGS. 12-13. Thus, the rear shell assembly (comprising the rear shell portions 182A,182B) may pivot about the hinge 184 with respect to the front shell assembly (comprising the front shell portions 180A,180B), as discussed in more detail below.

The at least one shell 131A,131B changes the outer configuration of a projectile launching device 111 onto which it is secured, as shown in the views of FIGS. 16-20. The at least one shell allows a projectile launching device 111 to engage a projectile hopper (not shown) so projectiles can be fed from the hopper to the device through a paintball receiver 119 while the at least one shell 131A,131B is secured to the device.

Figure 24:
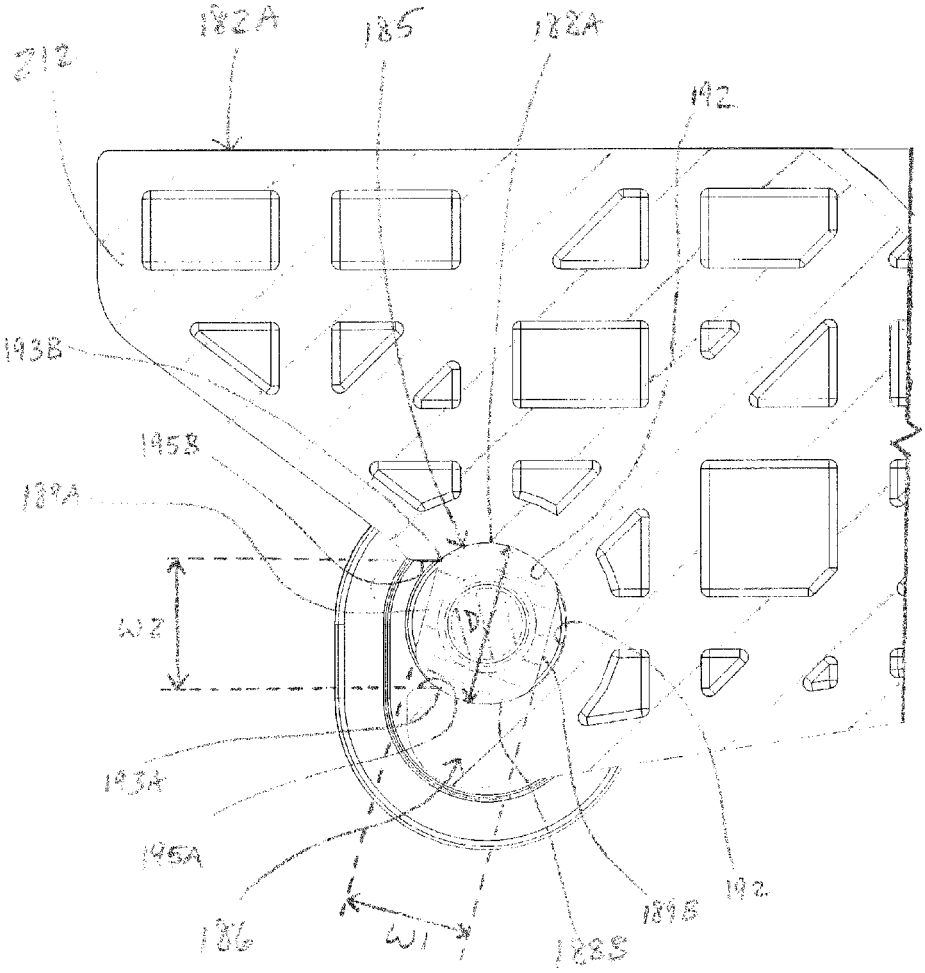
FIG. 24 shows engagement of a hinge.

In the second embodiment of the conversion kit 110, the hinge 184 includes two pins 185 and two knuckles 186 that respectively engage the pins 185. Each pin 185 is respectively secured to the respective front portion 180A,180B of one of the shells 131A,131B, and each knuckle 186 is formed on the respective rear portion 182A,182B of one of the shells 131A,131B. In embodiments not shown, this may be reversed, with the knuckles on the respective front portions, and the pins on the respective rear portions. FIG. 24 shows the engagement of a pin 185 with a knuckle 186 on a rear portion 182A of a shell 131A, and is discussed in more detail below.

Figure 21:
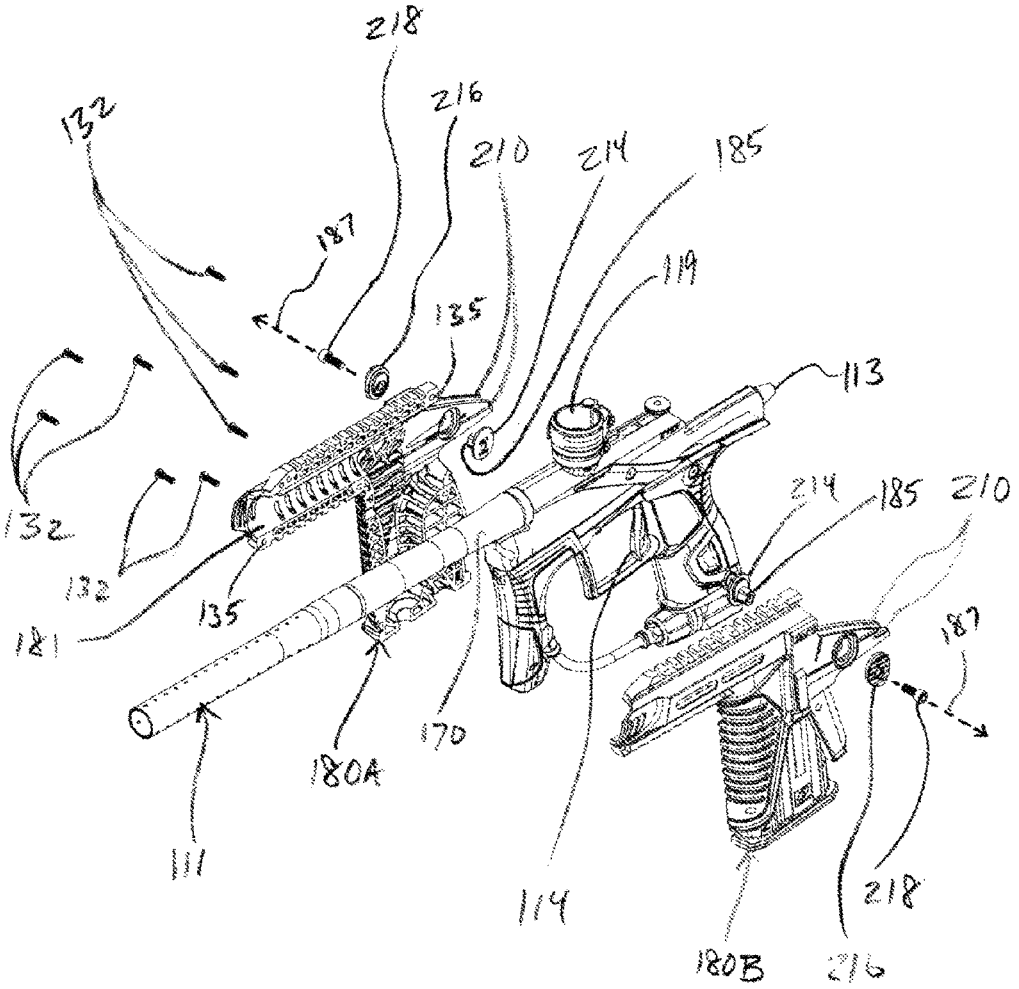
FIG. 21 shows an exploded view of a first front shell portion, a second front shell portion, and a standard paintball marker.

Each pin 185 extends along the same pin axis 187, as shown in FIG. 21. Each pin 185 is dimensioned and configured to be received in a respective one of the knuckles 186, as shown in FIG. 24. Rotation of each knuckle 186 about the respective pin 185 effects pivoting of the front assembly (made of the front portions 180A,180B) with respect to the rear assembly (made of the rear portions 182A,182B) about the pin axis 187, when each pin 185 is received in the respective knuckle 186.

Figure 22:
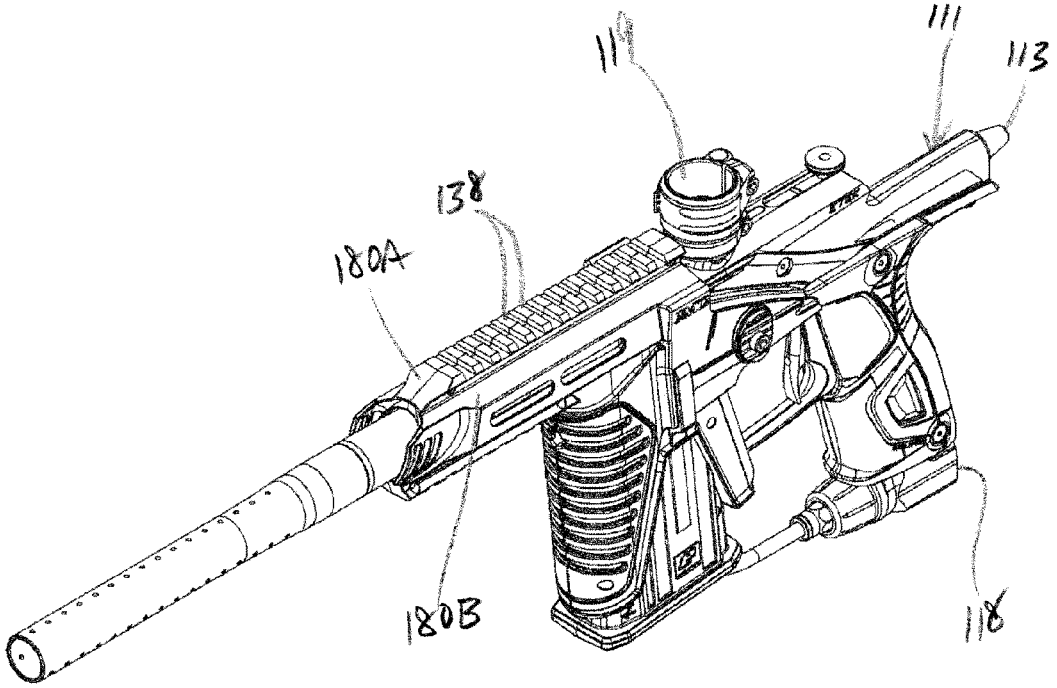
FIG. 22 shows a perspective view of a first front shell portion and a second front shell portion secured to a standard paintball marker.
Figure 23A:
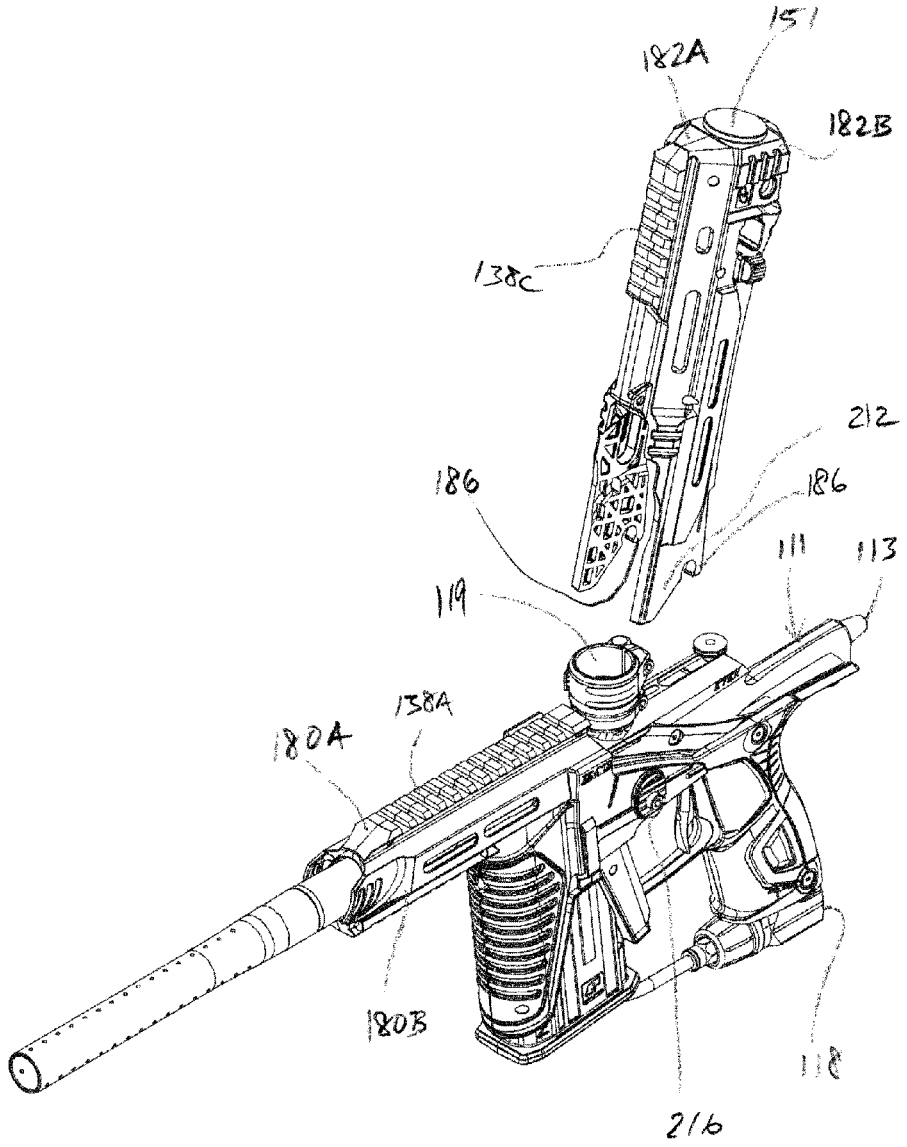
FIG. 23A shows the perspective view of FIG. 22, with a rear shell assembly before it has been secured to the front shell assembly.
Figure 23B:
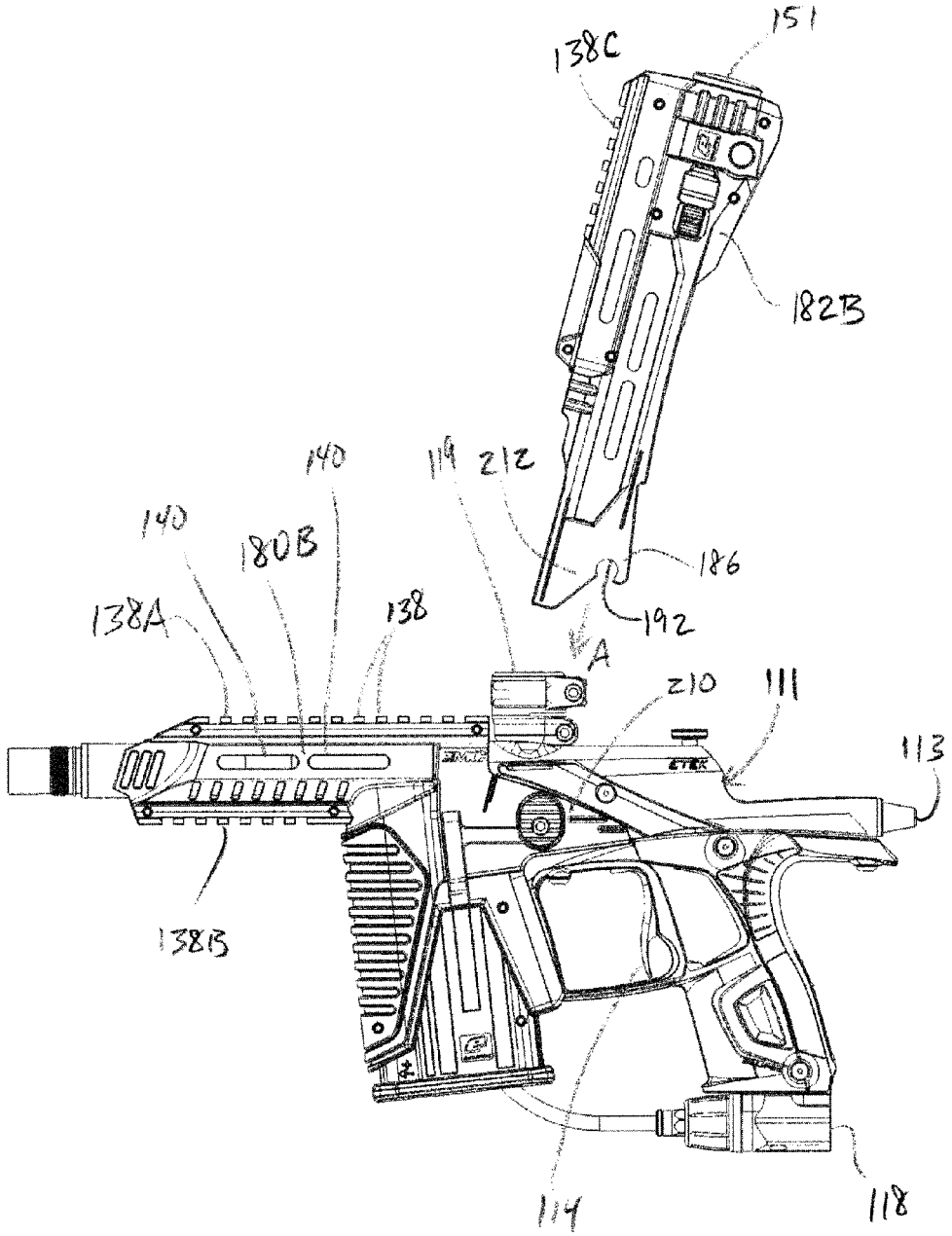
FIG. 23B shows a side view thereof.

Generally, when securing the second embodiment of the conversion kit 110 to a projectile launching device 111, the user first secures the one or more front portions 180A, 180B to the projectile launching device 111, as shown in the exploded view of FIG. 21 and the partially assembled view of FIG. 22. Then the user secures the one or more rear portions 182A,182B to the front portions 180A,180B by engaging each knuckle 186 with its respective pin 185. In the case of the second embodiment 110 as illustrated, the user secures the front portions 180A,180B of the shells 131A,131B around a projectile launching device 111 to form a front shell assembly around the projectile launching device, as shown in FIG. 21. Then the user secures the rear portions 182A,182B of the shells 131A,131B to form a rear shell assembly, and the user orients the rear shell assembly so that the knuckles 186 can receive the respective pins 185, as described in more detail below. In the second embodiment, to insert the pins 185 into the respective knuckles 186, a user aligns the front portions 180A,180B and rear portions 182A,182B as shown in FIGS. 23A-23B. Then the user moves the rear portions 182A,182B along the arrow A towards the hinge 184, so that the pins are received in the slots. This selective insertion of the pins 185 into the knuckles 186 is possible because of the geometry of the pins 185 and the knuckles 186, discussed in more detail below.

As shown in FIG. 24, each pin 185 has an outer surface that includes two opposed arced walls 188A,188B that extend along a circle having a diameter D. The opposed arced walls 188A, 188B are connected by two opposed flat walls 189A,189B. The distance between the two flat walls 189A,189B is a first width W1, and the first width W1 is less than the diameter D of the circle.

Each respective knuckle 186 has an inner knuckle surface 192 that extends along an arc from a first edge 193A to a second edge 193B. A gap is defined between the first edge 193A of the inner knuckle surface 192 and the second edge 193B of the inner knuckle surface. The gap has a second width W2. A first gap side wall 195A is adjacent to the first edge 193A of the inner knuckle surface 192, and a second gap side wall 195B is adjacent to the second edge 193B of the inner knuckle surface 192. The first and second gap side walls 195A,195B are at least substantially parallel, and are configured so that there is a gap at least as great as the second width W2 between the first and second gap side walls 195A,195B along their lengths.

To allow a user to selectively insert each pin into its respective knuckle, this second width W2 is at least as great as the first width W1. That is, there is sufficient clearance between the flat walls 189A,189B of the pin 185 and side walls 195A,195B of the knuckle 186 to allow the pin 185 to be received by the knuckle 186, or the respective materials of the pin 185 and the knuckle 186 allow for the pin 185 to be received by the knuckle 186 due to the deformability of the respective materials or the low friction of the respective materials or a combination thereof. For example, each pin could snap into a respective knuckle where there is insufficient clearance to simply slide the pin into place.

When each pin 185 is received in its respective knuckle 186, at least one of the arced walls 188A,188B of the pin 185 is in facing relation or in direct facing engagement with the inner knuckle surface 192, as shown in FIG. 24.

After passing the opposed flat surfaces 189A,189B of each pin 185 through the gap between the side walls 195A,195B of the respective knuckle 186, the user can rotate the rear shell assembly (comprising the rear shell portions 182A,182B) with respect to the front shell assembly (comprising the front shell portions 180A,180B). When the user rotates the rear shell assembly downward, towards the underlying projectile launching device 111 (i.e. a rotation from the orientation of FIGS. 25A-25B to the orientation of FIGS. 12-13), the opposed flat walls 189A,189B of each pin 185 are no longer aligned with side walls 195A,195B that form the gap of the respective knuckle 186. Thus, a user cannot remove the rear shell assembly from the front shell assembly without rotating the rear shell assembly with respect to the front shell assembly to realign the opposed flat walls of the pins with the gaps of the respective knuckles.

Figure 25A:
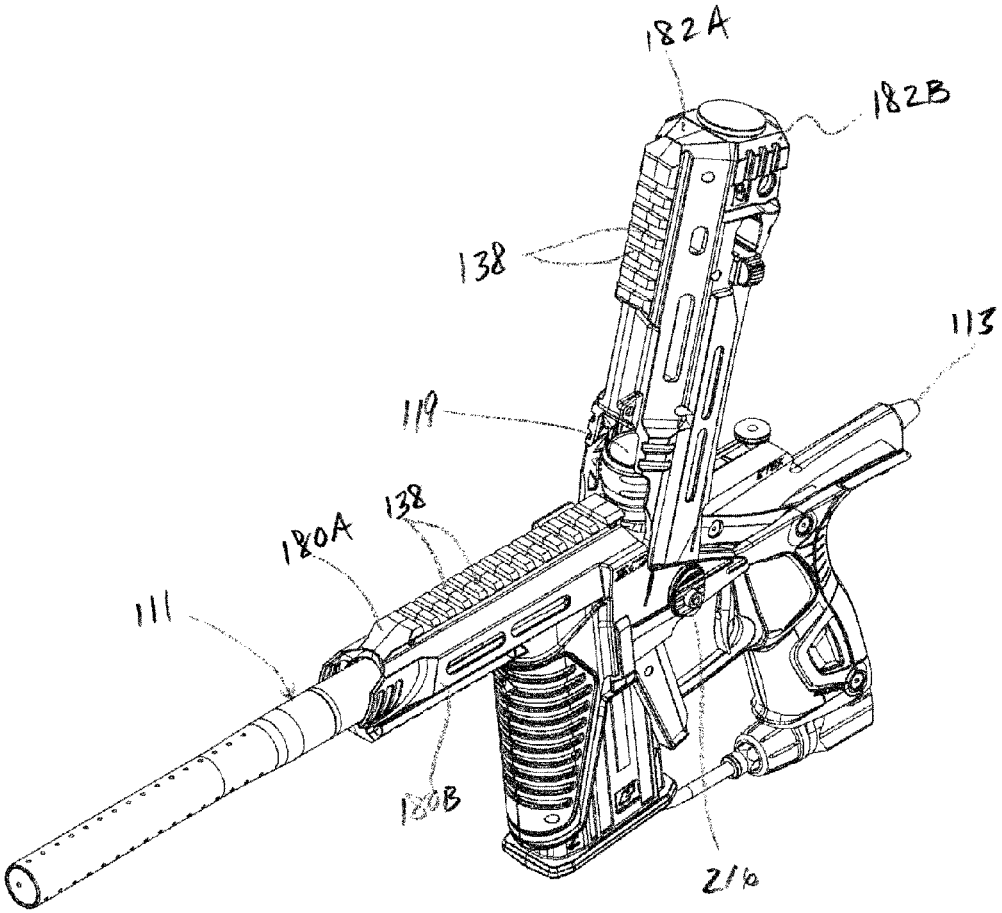
FIG. 25A shows the perspective view of FIG. 22, with a rear shell assembly that has been secured to the front shell assembly.
Figure 25B:
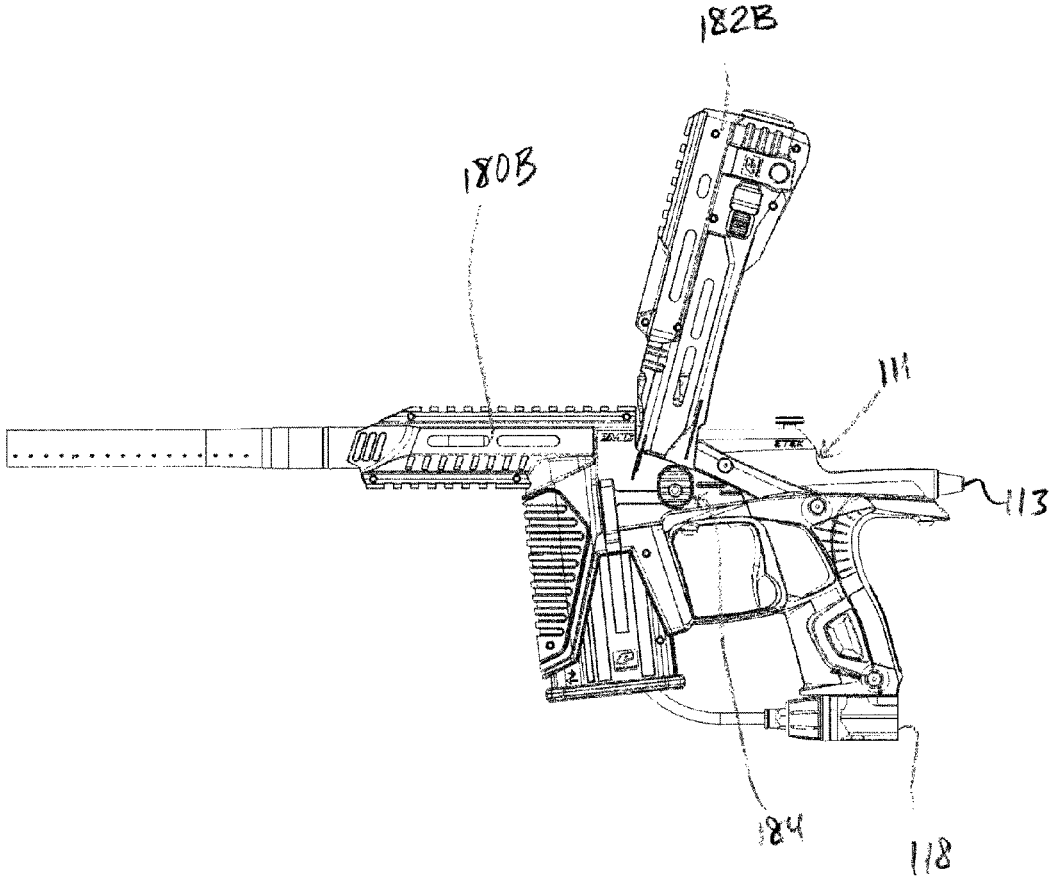
FIG. 25B shows a side view thereof.
Figure 26:
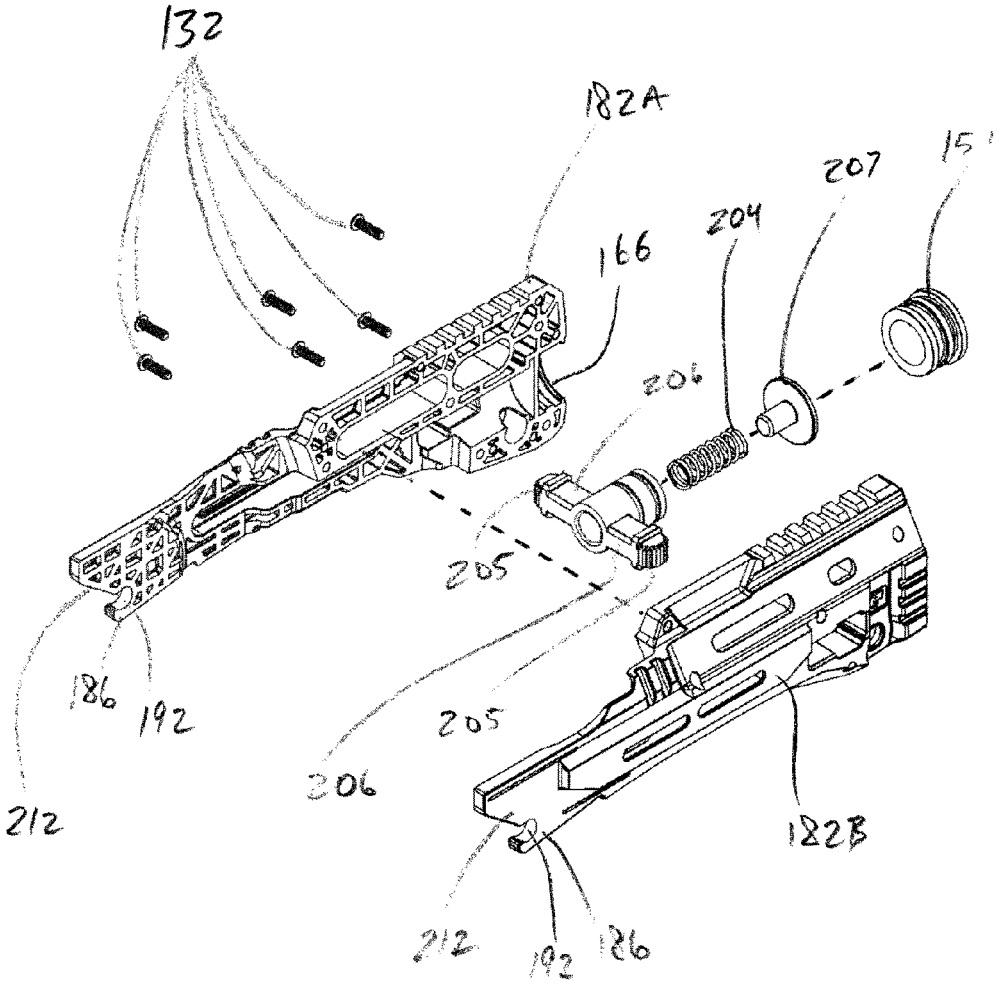
FIG. 26 shows an exploded view of the locking bolt.
Figure 27:
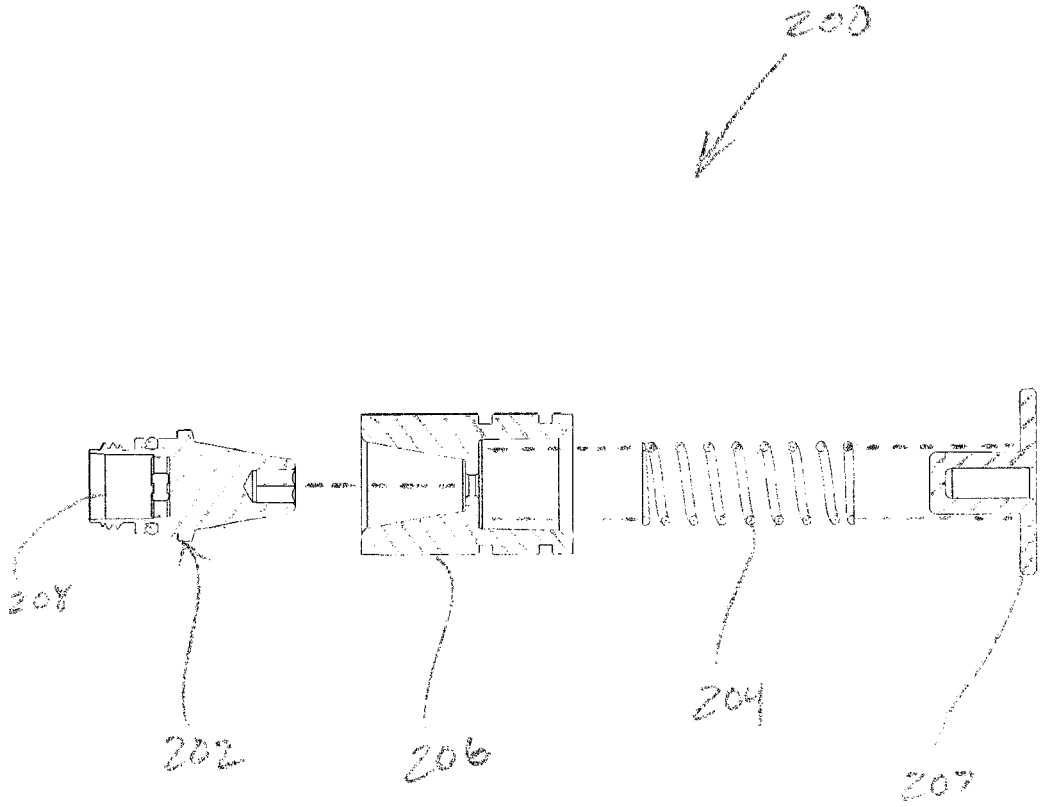
FIG. 27 shows an exploded cross section of the locking bolt.
Figure 28A:
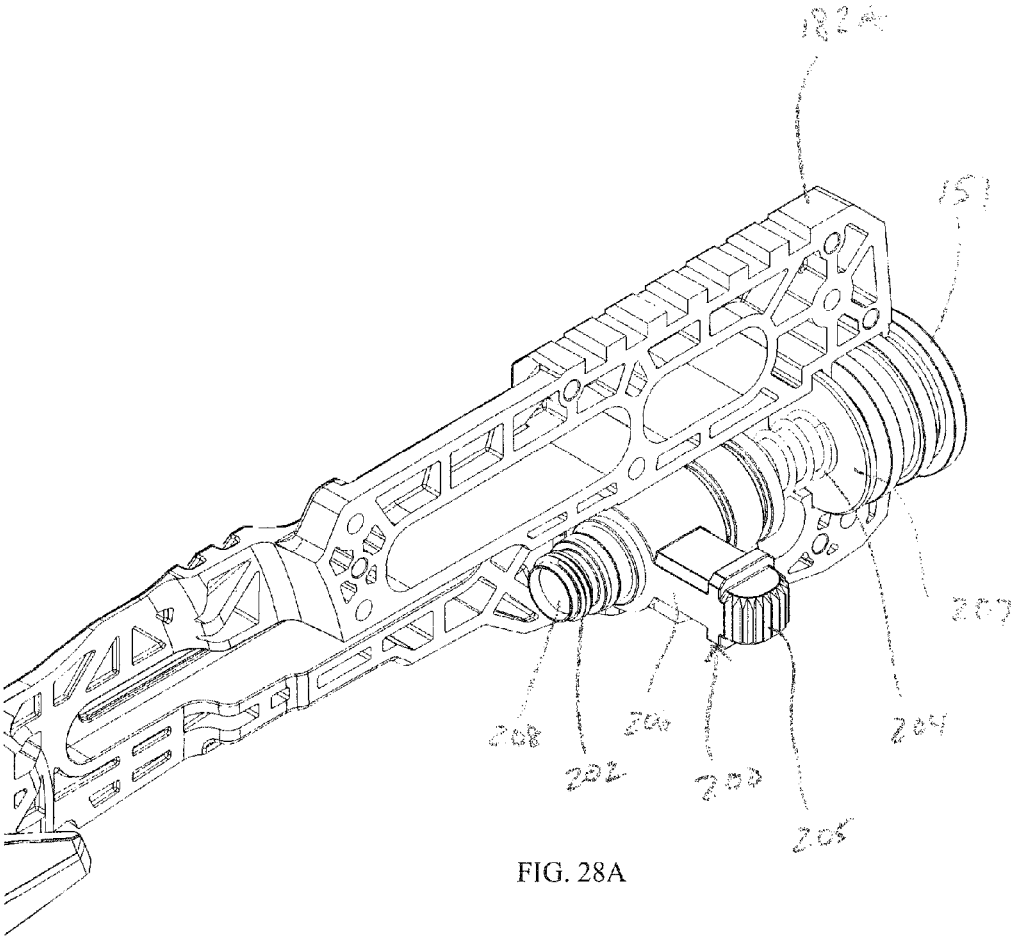
FIGS. 28A-C show views of a locking bolt, with one rear shell portion hidden from view.
Figure 28B:
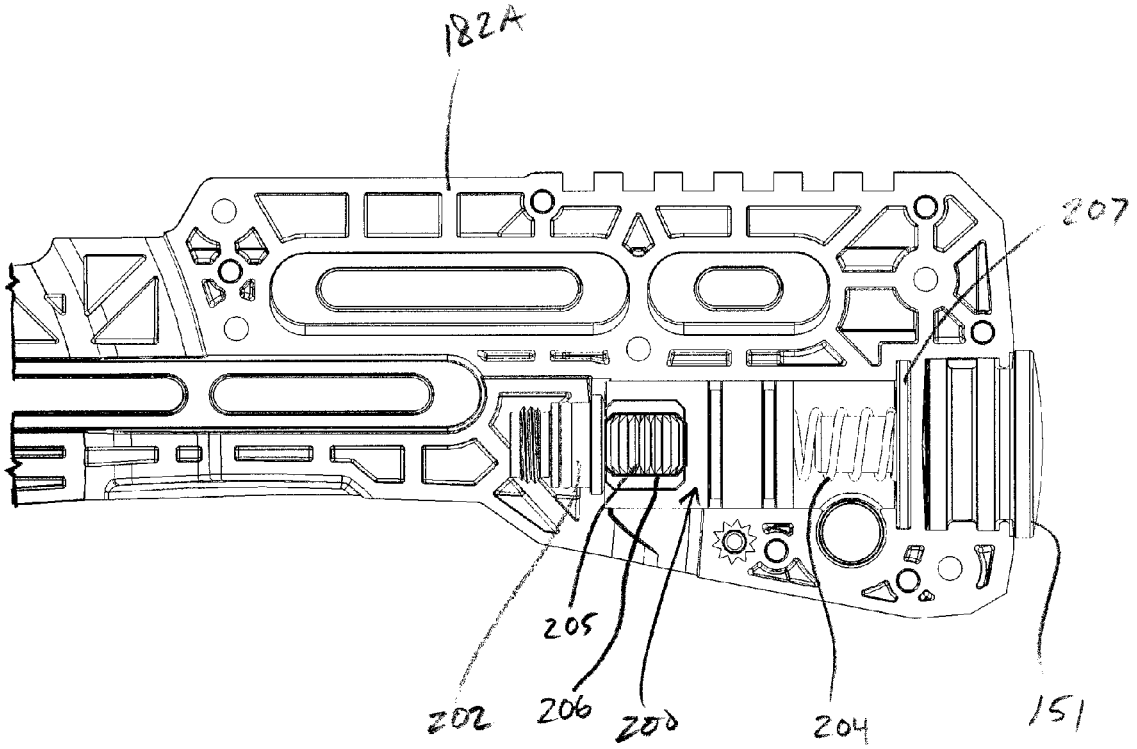
Figure 28C:
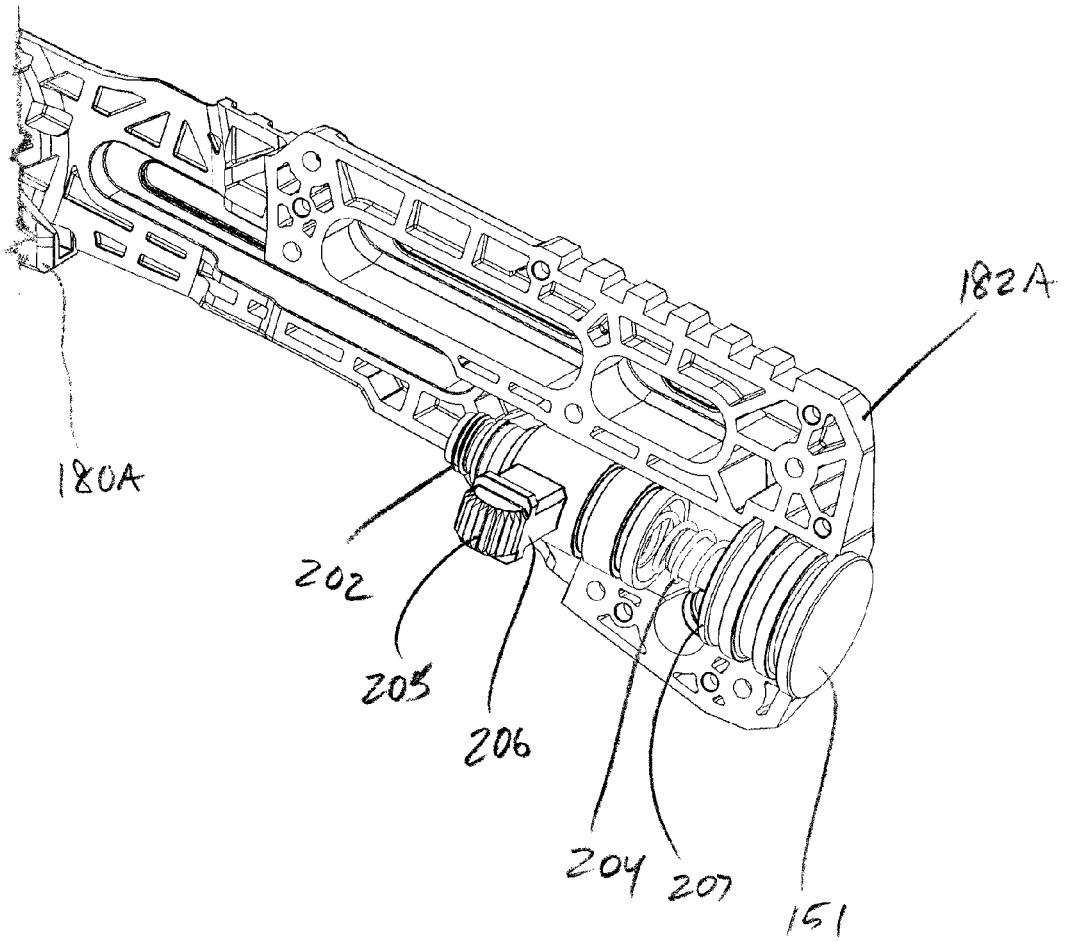

To rotationally secure the rear shell assembly with respect to the front shell assembly, and with respect to the underlying projectile launching device 111 when the rear shell assembly is rotated to the lowered orientation of FIG. 25B, the second embodiment of the conversion kit 110 further comprises a locking bolt assembly 200 that releasably engages an underlying marker 111. The locking bolt assembly is shown in more detail in FIGS. 26-28C. The locking bolt assembly includes a locking bolt 202 that is slidably supported by the one or more of the rear shell portions 182A,182B. In the second embodiment of the conversion kit 110, the locking bolt 202 is supported by both of the rear shell portions 182A,1822B of the rear shell assembly.

The locking bolt 202 is movable from a locked position to an unlocked position. In the second embodiment of the conversion kit 110, the locking bolt 202 can be moved rearward to its unlocked position in which it does not engage the rear surface 113 of the projectile launching device 111, and can be moved forward to its locked position in which it does engage the rear surface 113 of the projectile launching device 111. In the second embodiment of the conversion kit 110, the locking bolt assembly includes a spring 204 so that the locking bolt 202 is spring biased forward to the locked position. The spring is seated against a spring mounting plate 207 secured between the rear shell portions 182A, 182B. The spring 204 thus engages the spring mounting plate 207 at a first end of the spring 204 and engages the locking bolt actuator 206 at the other end of the spring 204. A user can slide the locking bolt rearward to the unlocked position by manually applying a force to bolt grip surfaces 205 on a bolt actuator 206 that is sufficient to overcome the spring force of the spring 204. Then, the user can release the locking bolt actuator 206 to let the locking bolt 202 return to its forward position.

When the rear shell assembly (comprising the rear shell portions 182A,182B) of the second embodiment of the conversion kit 110 is fully rotated downward to the orientation shown in FIG. 13, and when the locking bolt 202 is in the locked position, a front locking bolt surface 208 of the locking bolt 202 is configured to engage a rear surface 113 of a projectile launching device 111 onto which the at least one shell is secured when the locking bolt 202 is in the locked position.

The at least one shell 131A,131B is capable of being secured about a projectile launching device using fasteners 132. The fasteners can be selected from the group consisting of: threaded fasteners, cable ties, clips, and ratchets. Other fasteners can be used without departing from the scope of the present invention. In FIG. 21, the two front shell portions 180A,180B are shown as being secured together by fasteners 132 in the form of threaded fasteners that extend through holes in a first front shell portion 180A, and are received in threaded receivers 133 in the second front shell portion 180B. FIG. 13 shows how the shells 131A, 131B (preferably two half shells) can be secured together, as they may be secured onto and about the body of a marker 111. It is envisioned that the two half shells 131A, 131B can be retained together by any means possible. For example, it is possible to retain the shells together by a fastener, such as a screw and retained nut arrangement, as in the first embodiment. FIG. 21 shows male threaded screws 132 routed through pass through holes 135 on one shell 131A and into female threaded holes 133 on the other shell 131B. Other possible ways to retain the shells together could be cable ties, clips, ratchets and any other structure envisioned including any of those envisioned by a person of ordinary skill in the art. The first and second front shell portions are secured together by fasteners, and the first and second rear shell portions are secured together by fasteners.

The at least one shell 131A,131B is capable of at least substantially fully enshrouding a projectile launching device 111. Thus, the at least one shell 131A,131B allows a projectile to be launched from the barrel of the projectile launching device 111, allows projectiles to be fed into the projectile launching device through a projectile receiver 119 from an external hopper, and allows a gas line to be connected to the a gas tube receiver 118 on the projectile launching device 111 that relies on compressed air.

The at least one shell 131A,131B of the conversion kit 110 is capable of converting a non-MILSIM type projectile launching device into a MILS IM type projectile launching device (for example, compare the appearance of the marker in FIGS. 12 and 21).

Each front shell portion 180A,180B further comprises an inner surface 181 that is a mating surface for engaging an outer surface 170 of the projectile launching device 111. The engagement of the respective inner surfaces 181 of the front shell portions 180A,180B with the outer surface 170 of the projectile launching device 111 increase stability of the shells with respect to the projectile launching device when the shells are mounted on a projectile launching device. FIG. 21 shows the contact surfaces of the shell that engage the underlying paintball marker when fully assembled. The contact surfaces of the shells are inner surfaces of the shells that are configured to be in direct facing engagement with outer surfaces of an underlying paintball marker. It should be understood that these contact surfaces for engaging the marker 111 are just one example. Any other complementary contact surface mate between a marker 111 and the shells 131A, 131B can be employed and still be within the scope of the present invention. For example, there can be many contact points formed on the respective inner surface of one or more of the shells. A wide variety of arrangements are possible and are considered to be covered by this invention.

The inner surfaces 181 of the shell 131A, 131B, as in FIG. 5, are placed against the outer surface 170 of the marker 111, and are held in tension around the marker.

When the two rear shell portions 182A, 182B are mated together and enshrouding the marker 111, they leave a rear open end defined by rear opening edges 166 on each of the rear shell portions 182A,182B. This open end can be either closed up or have an accessory mounted therein. More specifically, a blanking plug 151 (see FIGS. 15A, 15B, 26) is receivable into the rear open end defined by the opening edges 166. In FIGS. 15A and 15B, where one shell is not shown for illustration purposes, it can be seen that open end defined by the opening edges 166 is rearwardly facing. Plug 151 is configured to be complementary in shape to the open end defined by the opening edges 166. In another embodiment, the plug could be modified to include be retained by a lever, as in the first embodiment.

Each front shell portion 180A,180B includes two hinge support walls 210 that are laterally spaced apart, and that are located at the rear end of the respective front shell portion 180A,180B. A slot is defined between the pair of spaced apart hinge support walls 210, as visible in FIG. 21. The width of the slot is dimensioned to receive the arm 212 on the front of the respective rear shell portion 182A,182B. The knuckle 186 is defined at the front end of the arm 212. When the conversion kit 110 is fully assembled, the arms 212 of the rear shell portions 182A,182B of the rear shell portions 182A,182B are received between the respective hinge support walls 210 of the front shell portions 180A,180B of the front assembly.

Each hinge pin 185 is formed on and extends from a respective mounting plate 214. The mounting plate 214 is secured to the respective front shell portion 180A,180B. FIG. 21 shows two mounting plates 214. The mounting plate 214 is received in facing engagement with a first one of the hinge walls 210, and a face plate 216 is secured in facing engagement with a second one of the hinge walls. A hinge fastener 218 extends through the face plate 216 along the pin axis 187, and is received in threaded engagement with a female threaded receiver in the pin 185 that extends from the respective mounting plate 214.

Other structures for supporting the hinge pin are possible. Other methods of forming a hinge pin are also possible, such as integrally forming the hinge pin on the front shell portion through injection molding.

The second embodiment of the conversion kit 110, as discussed above and as shown in the figures, preferably has two shells 131A, 131B that are secured on the marker 11. While two shells are preferred, it is envisioned that the conversion kit 110 may include more than two shells, such as where multiple shells are secured about each side of the marker 11. These variations in the configuration of the shells are considered to be within the scope of the present invention.

As shown in FIG. 13, for example, the shells have apertures 140 through the sides of the shells 131A, 131B and a rail system 138A formed on the upper surfaces of the shells and rail system 138B on the lower surface of the shells 131A and 131B. Each shell 131A,131B has front and rear portions, each with an outer surface, and the outer surfaces together form a rail system 138 for mounting objects thereto. The front shell portions 180A,180B cooperate to form an upper front rail system 138A and a lower front rail system 138B, and the rear shell portions 182A,182B cooperate to form a rear rail system 138C. It should be noted that the tops of the shell portions of shells 131A and 131B are shown to respectively provide a partial rail system. When the shells 131A and 131B are mated together, as in FIG. 13, they form, together, a full rail system of a desirable width. It is also possible that the rail system is provided on only one of the shells. It is also possible that the rail system is provided on any surface of the shells. Although the rail system shown in the figures resembles a common rail system design, other rail systems are also possible. Also, although the figures show a rail system 138A on the upper surfaces of the shells and a rail system 138B on an underside of the shells, in other embodiments, the rail system may be provided on a lower, or any surface of the shells, such that objects could be mounted directly below or on any surface of the shells 131A, 131B.

Although the conversion kit 110 is shown as including two shells in the figures, the conversion kit could also be formed of a single shell having a front portion and a rear portion. For example, a shell could be formed as with a single front portion that is capable of being placed around a marker. The front portion and the rear portion, connected by a hinge, completely enshroud the marker 111. A single shell could also be provided with a flexible front and rear portion that can be secured around a marker. Another example of a single shell would be a shell that provides an upper shroud for a marker and has an aperture in the lower surface of the shell for receiving a marker. Single shell embodiments such as these would allow the user to more quickly convert the marker to a MILSIM type marker, and also provide a conversion kit that more closely simulates a real firearm.

In view of the foregoing, a new and novel rail kit system and conversion kit 110 is provided that can easily convert a standard paintball marker or air soft gun 111 from a speedball non-MILSIM setup with no rail system to a scenario MILSIM type setup where a rail kit 131A, 131B fully enshrouds the marker or gun 111 to better simulate a real MILSIM firearm and provide a rail system 138A-C for receipt of accessories thereon.

The second embodiment of the rail kit 110 of the present invention may be made out of any suitable material and manufactured in many different ways. For example, the rail kit 110 may be molded out of plastic or machined from metal, such as aluminum. Any such material and method of manufacture is considered within the scope of the present invention.

It would be appreciated by those skilled in the art that various changes and modifications can be made to the illustrated embodiments without departing from the spirit of the present invention. All such modifications and changes are intended to be covered by the appended claims.

What is claimed is:

1. A conversion kit for a projectile launching device having an outer configuration, comprising:

at least one shell that is capable of being secured on a projectile launching device; the projectile launching device including a front portion; a rear portion and a trigger defining a vertical plane;

the at least one shell further comprising a front shell portion and a rear shell portion, the front shell portion and the rear shell portion being rotatably connected at a hinge so that the rear shell portion may pivot about the hinge with respect to the front shell portion;

the front shell portion including a cavity for housing the front portion of the projectile launching device and the rear shell portion including a recess in the bottom thereof for housing the rear portion of the projectile launching device; the rear shell pivoting about the hinge in a vertical direction and within the vertical plane;

the hinge further comprising at least one pin secured to one of the front shell portion and the rear shell portion, the at least one pin extending along a pin axis;

at least one knuckle formed on the other of the front shell portion and the rear shell portion;

each pin being dimensioned and configured to be received in a respective one of the knuckles;

each pin having an outer surface comprising two opposed arced walls, the opposed arced walls extending along a circle, the circle having a diameter; the opposed arced walls being connected by two opposed flat walls, the distance between the two flat walls being a first width, the first width being less than the diameter of the circle;

each respective knuckle having an inner knuckle surface that extends along an arc from a first edge to a second edge;

a gap defined between the first edge of the inner knuckle surface and the second edge of the inner knuckle surface, the gap having a second width;

whereby rotation of each knuckle about the respective pin effects pivoting of the front shell portion with respect to the rear shell portion about the pin axis, when each pin is received in the respective knuckle;

whereby the at least one shell changes the outer configuration of a projectile launching device onto which it is secured; and the at least one shell allows a projectile launching device to engage a projectile hopper so projectiles can be fed from the hopper to the device while the at least one shell is secured to the device.

2. The conversion kit of claim 1, wherein the front shell portion includes two shell halves mated together and the rear shell portion includes two shell halves mated together;

whereby the two shell halves of the front shell portion are spatially fixed relative to each other, and the two shell halves of the rear shell portion are spatially fixed relative to each other, so the rear shell portion may pivot together about the hinge with respect to the front shell portion.

3. The conversion kit of claim 1, wherein the second width is at least as great as the first width.

4. The conversion kit of claim 1, further comprising:

a locking bolt that releasably engages an underlying projectile launching device, the locking bolt being slidably supported by the rear shell portion;

the locking bolt being movable from a locked position to an unlocked position;

the locking bolt having a front locking bolt surface configured to engage a rear surface of the projectile launching device onto which the at least one shell is secured when the locking bolt is in the locked position.

5. The conversion kit of claim 4, wherein the locking bolt further comprises a spring to spring-bias the locking bolt.

6. The conversion kit of claim 1, wherein the at least one shell is capable of being secured about a projectile launching device using fasteners.

7. The conversion kit of claim 6, wherein the fasteners are selected from the group consisting of: threaded fasteners, cable ties, clips, and ratchets.

8. The conversion kit of claim 1, wherein the at least one shell is capable of at least substantially fully enshrouding a projectile launching device.

9. The conversion kit of claim 1, wherein the at least one shell is capable of converting a non-MILSIM type projectile launching device into a MILSIM type projectile launching device.

10. The conversion kit of claim 1, wherein the at least one shell has an outer surface, and the outer surface of the at least one shell together form a rail system for mounting objects thereto.

11. The conversion kit of claim 1, wherein the front shell portion and the rear shell portion each further comprise:

an inner surface; and at least one mating surface on the inner surface; each mating surface being capable of engaging a corresponding mating surface on an outer surface of a projectile launching device to increase stability of the shells when mounted on a projectile launching device.

12. A convertible projectile launching system comprising:

a projectile launching device; the projectile launching device including a front portion, a rear portion and a trigger defining a vertical plane;

at least one shell that is capable of being secured on the projectile launching device;

the at least one shell further comprising a front shell portion and a rear shell portion, the front shell portion and the rear shell portion being rotatably connected at a hinge so that the rear shell portion may pivot about the hinge with respect to the front shell portion;

the front shell portion including a cavity for housing the front portion of the projectile launching device and the rear shell portion including a recess in the bottom thereof for housing the rear portion of the projectile launching device; the rear shell pivoting about the hinge in a vertical direction and within the vertical plane;

the hinge further comprising at least one pin secured to one of the front shell portion and the rear shell portion, the at least one pin extending along a pin axis;

at least one knuckle formed on the other of the front shell portion and the rear shell portion;

each pin being dimensioned and configured to be received in a respective one of the knuckles;

each pin having an outer surface comprising two opposed arced walls, the opposed arced walls extending along a circle, the circle having a diameter; the opposed arced walls being connected by two opposed flat walls, the distance between the two flat walls being a first width, the first width being less than the diameter of the circle;

each respective knuckle having an inner knuckle surface that extends along an arc from a first edge to a second edge;

a gap defined between the first edge of the inner knuckle surface and the second edge of the inner knuckle surface, the gap having a second width;

whereby rotation of each knuckle about the respective pin effects pivoting of the front shell portion with respect to the rear shell portion about the pin axis, when each pin is received in the respective knuckle;

whereby the at least one shell changes the outer configuration of the projectile launching device onto which it is secured; and the at least one shell allows the projectile launching device to engage a projectile hopper so projectiles can be fed from the hopper to the device while the at least one shell is secured to the device.

13. The system of claim 12, wherein the front shell portion includes two shell halves mated together and the rear shell portion includes two shell halves mated together;

whereby the two shell halves of the front shell portion are spatially fixed relative to each other, and the two shell halves of the rear shell portion are spatially fixed relative to each other, so the rear portion may pivot together about the hinge with respect to the front shell portion.

14. The system of claim 12, wherein the second width is at least as great as the first width.

15. The system of claim 12, further comprising:

a locking bolt that releasably engages the underlying projectile launching device, the locking bolt being slidably supported by the rear shell portion;

the locking bolt being movable from a locked position to an unlocked position;

the locking bolt having a front locking bolt surface configured to engage a rear surface of a projectile launching device onto which the at least one shell is secured when the locking bolt is in the locked position.

16. The system of claim 15, the locking bolt further comprising a spring so that the locking bolt is spring biased.

17. The system of claim 12, wherein the at least one shell is capable of being secured about the projectile launching device using fasteners.

18. The system of claim 17, wherein the fasteners are selected from the group consisting of threaded fasteners, cable ties, clips, and ratchets.

19. The system of claim 12, wherein the at least one shell is capable of at least substantially fully enshrouding the projectile launching device.

20. The system of claim 12, wherein the projectile launching device is a non-MILSIM type projectile launching device, and wherein the at least one shell is capable of converting a non-MILSIM type projectile launching device into a MILSIM type projectile launching device.

21. The system of claim 12, wherein the at least one shell has an outer surface, and the outer surface of the at least one shell form a rail system for mounting objects thereto.

22. The system of claim 12, wherein the front shell portion and the rear shell portion each further comprise:

an inner surface; and at least one mating surface on the inner surface; each mating surface being capable of engaging a corresponding mating surface on an outer surface of the projectile launching device to increase stability of the front shell portion and the rear shell portion when mounted on the projectile launching device.

* * * * *